US012710196B2

(12) United States Patent
Sung et al.

(10) Patent No.: US 12,710,196 B2
(45) Date of Patent: Aug. 18, 2026

(54) BUMPER FOR PORTABLE AIR CONDITIONER

(71) Applicant: HEPHZIBAH CO., LTD., Incheon (KR)

(72) Inventors: Cha Hyun Sung, Incheon (KR); Hyeon Ho Jeong, Incheon (KR); In Jae Lee, Incheon (KR); Jae Hoon Kim, Incheon (KR)

(73) Assignee: HEPHZIBAH CO., LTD., Incheon (KR)

( * ) Notice: Subject to any disclaimer, the term of this patent is extended or adjusted under 35 U.S.C. 154(b) by 357 days.

(21) Appl. No.: 18/427,938

(22) Filed: Jan. 31, 2024

(65) Prior Publication Data

US 2024/0255173 A1 Aug. 1, 2024

(30) Foreign Application Priority Data

Feb. 1, 2023 (KR) ..... 10-2023-0013805

(51) Int. Cl.
*F24F 13/20* (2006.01)
*F24F 1/04* (2011.01)

(52) U.S. Cl.
CPC ..... *F24F 13/20* (2013.01); *F24F 1/04* (2013.01)

(58) Field of Classification Search
CPC ..... F24F 1/04; F24F 13/20; F24F 2221/125; B62B 5/0006; F26F 7/003; F26F 7/12
See application file for complete search history.

(56) References Cited

U.S. PATENT DOCUMENTS 4,055,362 A * 10/1977 Becker, III ..... B62B 5/0006 293/121
4,265,184 A * 5/1981 Cox ..... B65D 71/0096 206/453
9,815,486 B2 * 11/2017 McMurtrey ..... B62B 3/02
2014/0265440 A1 * 9/2014 Chen ..... B62B 3/005 296/186.1

FOREIGN PATENT DOCUMENTS

KR 10-0573779 B1 4/2006
KR 20-0441282 Y1 8/2008
KR 20-0452811 Y1 3/2011
KR 10-2011-0110428 A 10/2011
KR 10-1138699 B1 4/2012
KR 10-2014-0067310 A 6/2014
KR 10-1593657 B1 2/2016

* cited by examiner

*Primary Examiner* — Allen R. B. Schult
(74) *Attorney, Agent, or Firm* — Carter, DeLuca & Farrell LLP; George Likourezos

(57) ABSTRACT

A bumper for a portable air conditioner is provided in the portable air conditioner. The bumper includes a first outer surface and a second outer surface connected to the first outer surface, and an upper bumper and lower bumper coupled to a lower side of the upper bumper. The upper bumper includes a first upper body fixed to the first outer surface, and a second upper body connected to the first upper body and being in contact with the second outer surface. The lower bumper includes a first lower body fixed to the first outer surface and coupled to a lower end of the first upper body, and a second lower body connected to the first lower body, coupled to a lower end of the second upper body, and being in contact with the second outer surface.

8 Claims, 29 Drawing Sheets

(a)

(b)

(a)

(b)

BUMPER FOR PORTABLE AIR CONDITIONER

CROSS-REFERENCE TO RELATED APPLICATION

This application claims priority to Korean Patent Application No. KR 10-2023-0013805 filed on Feb. 1, 2023, and all the benefits accruing therefrom under 35 U.S.C. § 119, the contents of which are incorporated by reference in their entirety.

BACKGROUND

The present disclosure relates to a bumper for portable air conditioner, and more particularly, to bumper for portable air conditioner which is capable of performing cooling and heating at the same time, has high space efficiency, and has improved user convenience.

In general, an air conditioner is constituted by a compressor, a condenser, an evaporator, and an expander and supplies cold or hot air to a building or room using an air conditioning cycle of compression-condensation-expansion-evaporation. Air conditioners are divided into separation type air conditioners, in which a compressor is disposed in an outdoor space, and integrated-type air conditioners, in which a compressor is manufactured integrally.

In such a separation type air conditioner, an indoor heat exchanger is installed in an indoor unit, and an outer heat exchanger and a compressor are installed in an outdoor unit. An integrated-type air conditioner is designed so that an indoor heat exchanger, an outdoor heat exchanger, and a compressor are installed in one housing, and is often manufactured so that moving wheels are installed at a lower portion to easily move to a required place.

The integrated-type air conditioner has been disclosed through Korean Patent Publication No. 10-1593657. Such an integrated air conditioner is designed to supply cold or hot air at the same time as a condenser and an evaporator, which are capable of functioning as a heat exchanger, are disposed together inside a housing.

In this case, a heat exchanger, a blower fan, and a passage connecting the heat exchanger to the blower fan are disposed front and rear surfaces of a case, respectively, and thus, external air is discharged forward through the front surface, and the introduced external air is discharged to a top surface through the rear surface. However, according to this arrangement design of the heat exchanger, the blower fan, and the passage, the integrated-type air conditioner increases in volume and thus is not compact to cause location restriction in use.

In addition, the integrated-type air conditioners have a limitation in that thermal interference between components may occur due to design requirements that satisfy space efficiency, and thus, it difficult to accurately measure a temperature of the external air using a temperature sensor.

In addition, when the integrated-type air conditioner is manufactured to be movable through moving wheels installed at a lower portion thereof, there is a limitation in that an outer appearance is damaged by collision due to the movement.

In addition, the integrated-type air conditioner has to withdraw and process a water tank in which condensate is stored. In this case, it is difficult to install a sensor that measures a water level in a draw-out type water tank, and there is a limitation of causing inconvenience to the user due to an interference when withdrawing the water tank disposed at a lower portion thereof.

In addition, the integrated-type air conditioner has a limitation in that, as a negative pressure is generated inside the housing, the condensate flowing inside the housing is scattered to cause corrosion of other components.

SUMMARY

The present disclosure provides a portable air conditioner that is capable of performing cooling and heating at the same time and has high space efficiency.

The present disclosure also provides a portable air conditioner capable of accurately measuring a temperature of external air by avoiding thermal interference.

The present disclosure also provides a bumper for a portable air conditioner capable of protecting an outer appearance from collision when moving.

The present disclosure also provides a portable air conditioner provided with a draw-out type water tank that is capable of improving user convenience and accurately measuring a water level.

The present disclosure also provides a portable air conditioner that is capable of discharging condensate from the inside without being scattered.

In an embodiment of the inventive concept, a portable air conditioner includes: a housing provided with a heat exchange chamber; a first heat exchanger heat-exchanged with external air introduced through a first side surface of the housing; a second heat exchanger heat-exchanged with external air introduced through a second side surface of the housing, which is disposed at an opposite to the first side surface of the housing; a first guide part configured to guide the external air, which is heat-exchanged with the first heat exchanger, to a front part of the heat exchange chamber; a second guide part configured to guide the external air, which is heat-exchanged with the second heat exchanger, to a rear part of the heat exchange chamber; a partition wall provided between the first guide part and the second guide part to prevent the external air guided to the front part and the rear part of the heat exchange chamber from being mixed with each other; and a blower fan provided to pass through the partition wall and configured to discharge the external air, which is guided to each of the front part and the rear part of the heat exchange chamber, upward.

The first guide part may be provided on a first side part of the heat exchange chamber, the second guide part may be provided on a second side part disposed at an opposite side of the first side part of the heat exchange chamber, and the partition wall may be configured to connect the first and second guide parts to each other.

The blower fan may be provided on an upper end of the partition wall, and in the first and second guide parts, a spaced distance between upper ends may be less than that between lower end to prevent the blower fan from interfering.

The first guide part may include: an upper end guide part configured to define a first space together with the first side surface of the housing; and a lower end guide part provided below the upper end guide part to define a second space together with the first side surface of the housing, wherein the second space may communicate with the first space and is larger than the first space.

The first guide part may include: an upper plate facing the first side surface of the housing; a lower plate facing the first side surface of the housing and provided below the upper plate; a rear plate coupled to the upper plate at a predetermined angle; a first inclined plate configured to connect the upper plate to the lower plate and provided to be inclined downward toward the inside of the housing; and a second inclined plate configured to connect the lower plate to the rear plate and provided to be inclined forward toward the inside of the housing.

The portable air conditioner may further include: a first drain pan provided below the first heat exchanger to collect condensate generated in the first heat exchanger; a second drain pan provided below the second heat exchanger to collect condensate generated in the second heat exchanger; a third drain pan communicating with the first drain pan and configured to collect the condensate introduced from the first drain pan and the condensate discharged from the second drain pan so as to discharge the condensate downward.

The third drain pan may be provided with a support plate configured to support the partition wall.

The first drain pan and the third drain pan may be integrated with each other.

The first and second drain pan may extend in a first direction, and the third drain pan may extend in a second direction crossing the first direction.

The first direction may be a forward and backward direction of the housing, and the second direction may be a left and right direction of the housing.

In an embodiment of the inventive concept, a portable air conditioner includes: a housing having an internal space; a heat exchanger provided in the internal space and heat-exchanged with external air introduced from the outside; a blower fan configured to generate a negative pressure in the internal space so that the external air is introduced, the blower fan allowing the heat-exchanged external air to move upward; a discharge port configured to guide the upwardly guided external air to the outside of the housing; a temperature sensor configured to measure a temperature of the external air; an accommodation part provided inside the housing to accommodate the temperature sensor; and a communication groove configured to allow the accommodation part and the internal space of the housing to communicate with each other so that the external air moves into the internal space of the housing via the accommodation part.

The portable air conditioner may further include an inner casing provided inside the housing and connected to the blower fan, wherein the inner casing may include: a front surface of which one side is recessed to define the accommodation part; a rear surface angled at a predetermined angle with respect to the front surface and disposed to face the internal space of the housing; and a front discharge passage adjacent to the accommodation part and configured to guide the external air introduced by the blower an to the outside of the front surface, wherein the communication groove may pass through an inner surface of the accommodation part and the rear surface.

The inner casing may further include a top surface configured to connect the front surface to the rear surface, and the communication groove may be defined by recessing one side of the top surface downward.

The housing may include a front inclined panel configured to cover the front surface of the inner casing, wherein the front inclined panel may include: a first through-hole configured to define the discharge port; a second through-hole communicating with the accommodation part and disposed adjacent to the first through-hole.

The second through-hole may include a main through-hole; and a sub through-hole provided below the main through-hole and having a surface area less than that of the main through-hole, wherein the temperature sensor may be provided on an area corresponding to the sub through-hole.

The main through-hole may include: one area; and the other area disposed at a side opposite to the one area and disposed further adjacent to the first through-hole than the one area, wherein the sub through-hole may communicate with the one area.

The portable air conditioner may further include an accommodation part cover configured to cover the second through-hole, wherein the accommodation part cover may be provided with a grill part configured to allow the inside and the outside to communicate with each other.

The portable air conditioner may further include a heat generation source accommodated in the accommodation part and comprising an electronic component that receives power to operate and generate heat, wherein the temperature sensor may be provided below the heat generation source, the communication hole may be provided above the heat generation source, and the grill part may be provided below the temperature sensor.

The heat generation source may include: a manipulation part configured to receive a user command including a command for operating one or more of the heat exchanger and the blower fan; and a display part accommodated in the accommodation part to display predetermined information including the input user command.

The internal space may include: a first internal space; and a second internal space separated from the first internal space, wherein the heat exchanger may include: a first heat exchanger provided in the first internal space to cool the external air; and a second heat exchanger provided in the second internal space to heat the external air, wherein the communication hole may be configured to allow the accommodation part and the second internal space to communicate with each other.

In an embodiment of the inventive concept, a bumper for a portable air conditioner is provided in the portable air conditioner including a first outer surface and a second outer surface connected to the first outer surface and includes an upper bumper and lower bumper coupled to a lower side of the upper bumper, wherein the upper bumper includes: a first upper body fixed to the first outer surface; and a second upper body connected to the first upper body and being in contact with the second outer surface, the lower bumper includes: a first lower body fixed to the first outer surface and coupled to a lower end of the first upper body; and a second lower body connected to the first lower body, coupled to a lower end of the second upper body, and being in contact with the second outer surface, wherein, in the upper bumper and the lower bumper, one or more of sliding operations on the first outer surface or the second outer surface interfere with each other.

The upper bumper may further include a first upper coupling rib provided on a lower end of the first upper body, and the lower bumper may further include a first lower coupling rib provided on an upper end of the first lower body and coupled to the first upper coupling rib, wherein the first upper coupling rib may be provided with a first upper interference surface parallel to the first outer surface and facing a first direction away from the second outer surface, and the first lower coupling ribs may be provided with a first lower interference surface that faces and in contact with the first upper interference surface.

The upper bumper may further include a second upper coupling rib provided on a lower end of the second upper body, and the lower bumper may further include a second lower coupling rib provided on an upper end of the second lower body and coupled to the second upper coupling rib, wherein the second upper coupling rib may be provided with a second upper interference surface and facing a second direction that is a direction opposite to the first direction, and the second lower coupling ribs may be provided with a second lower interference surface that faces and in contact with the second upper interference surface.

The first upper coupling rib may be provided with an outer interference surface parallel to the second outer surface and facing a third direction that faces the first outer surface, and the first lower coupling rib may be provided with an inner interference surface facing a fourth direction that is a direction opposite to the third direction.

The first upper coupling rib may include: an upper inner rib of which an inner surface is in contact with the first outer surface; an upper outer rib of which an inner surface is spaced apart from the first outer surface and which is connected to the second upper coupling rib; and an upper connection rib configured to connect the upper inner rib to the upper outer rib and having one side at which the first upper interference surface is defined.

The first upper body may be provided with an upper fixing part through which a fixing member configured to fix the first upper body to the first outer surface passes and is supported, wherein the upper fixing part may be closer to the upper outer rib than the upper inner rib and provided above the upper outer rib.

The first lower coupling rib may include: a lower inner rib that is in contact with an outer surface disposed at a side opposite to an inner surface of the upper inner rib; and a lower outer rib that is in contact with an outer surface disposed at a side opposite to an inner surface of the upper outer rib, wherein the lower inner rib may have a width greater than that of the lower outer rib and be provided with the first lower interference surface on a surface connected to the inner surface of the lower outer rib.

The first lower body may be provided with a lower fixing part through which a fixing member configured to fix the first lower body to the first outer surface passes and is supported, wherein the lower fixing part may be closer to the lower outer rib than the lower inner rib and provided below the lower outer rib.

The second upper coupling rib may be connected to the upper outer rib.

The first lower body may include: a first seating surface which has a height lower than that of an upper end surface of the lower inner rib to generate a stepped portion and on which the upper inner rib is seated; and a second seating surface which has a height lower than that of an upper end surface of the lower outer rib to generate a stepped portion and on which the upper outer rib is seated, and the second lower body may be provided with a third seating surface which has a height lower than that of an upper end surface of the second lower coupling rib to generate a stepped portion and on which the second upper coupling rib is seated.

In an embodiment of the inventive concept, a portable air conditioner includes: a housing having an internal space that is divided into an upper space and a lower space defined below the upper space; a heat exchanger provided in the upper space and heat-exchanged with external air introduced from the outside; a blower fan configured to introduce the external air so as to move to the heat exchanger and discharge the heat-exchanged external air upward; a water tank provided to be withdrawal forward in the lower space and configured to collect condensate generated in the heat exchanger; and a water level detection part configured to detect a water level of the water tank, wherein the water tank includes: a condensate inflow area which is provided on a front end of the water tank and into which the condensate is introduced; and a water level detection area which is provided on the front end of the water tank and at which the water level is detected, wherein the water level detection area is provided on a top surface of the front end of the water tank and has a height lower than the condensate inflow area to prevent the water level of the water tank from rising up to the condensate inflow area.

The water tank may further include a handle area provided on the front end of the water tank and provided with a handle, wherein the handle area may have a height greater than that of the condensate inflow area to prevent the condensate collected in the water tank from flowing back through the condensate inflow area and being discharged to the outside when the water tank is drawn out.

The water level detection part may include: a support frame extending downward from a ceiling part of the lower space; a proximate sensor supported by the support frame; and a floating part floated in the condensate collected in the water tank and comprises a predetermined magnet to be sensed by the proximate sensor, wherein the water tank may include: a first top surface provided with the condensate inflow area; a second top surface provided with the water level detection area, disposed adjacent to the first top surface, and configured to support one side of the floating part; and a third top surface extending backward form the second top surface, wherein the third top surface may have a height less than that of the second top surface to avoid an interference with the support frame when the water tank is drawn out.

The water tank may include: an inlet provided on the top surface of the front end of the water tank; and a guide groove extending long in a forward and backward direction on a top surface of the water tank and configured to guide the condensate to the inlet so that the bottom of the guide groove is inclined downward toward a front side.

The water tank may further include: a handle disposed on an edge at which the top surface and the front surface of the water tank are coupled to each other; and a grip hole in which one side of the top surface and one side of the front surface of the water tank are recessed to communicate with each other and which defines a space surrounding the handle.

The water tank may further include: an upper water tank; and a lower water tank provided on a lower end of the upper water tank to communicate with each other, having a cross-section less than that of the upper water tank, and being in contact with a bottom surface of the lower space.

The lower water tank may have a width less than that of the upper water tank and a length that is equal to or the same as that of the upper water tank.

The lower water tank may include: a first water tank bottom surface that is in contact with the bottom surface of the lower space; a second water tank bottom surface provided behind the first water tank bottom surface and having a height greater than that of the first water tank bottom surface; and an inclined bottom surface configured to connect the first water tank bottom surface to the second water tank bottom surface.

The first water tank bottom surface may be wider than the second water tank bottom surface and be provided with a plurality of downward convex portion protruding convexly downward to extend from a front end to a rear end thereof.

A hook protrusion configured to prevent the water tank from being separated may be provided in the lower space, and a bottom surface of the downward convex portion may have one side that is curved to define one surface with the front surface of the water tank.

The upper water tank may include a pair of third water tank bottom surfaces connected to the pair of side surfaces and provided at a position higher than the second water tank bottom surface to extend from a front surface to a rear surface of the upper water tank.

In an embodiment of the inventive concept, a portable air conditioner includes: a housing having an internal space; a heat exchanger provided in the internal space and heat-exchanged the external air introduced from the outside; a blower fan configured to generate a negative pressure in the internal space so that that the external air is introduced and configured to discharge the heat-exchanged external air upward; a drain pan provided below the heat exchanger and configured to collect condensate generated in the heat exchanger and discharge the condensate downward; a water tank configured to store the condensate discharged from the drain pan; a drain guide part provided in the drain fan and configured to guide the collected condensate and fall down to a lower portion of the drain pan; and a scattering prevention part provided above the drain guide part and configured to prevent the condensate guided by the drain guide part from being scattered by the negative pressure generated in the internal space.

The drain guide part may include: a drain pipe provided with a passage that guides the condensate collected in the drain pan downward; and a flange part provided at an upper end of the drain pipe and coupled to the bottom of the drain pan, wherein the scattering prevention part may include: a drain cover having a predetermined width and be curved convexly upward; and a cover support bar coupled to the flange part to support a self-weight of the drain cover.

The drain pipe may include: a first inclined cutoff part defined by cutting one side of a lower end in an upwardly convex shape; a second inclined cutoff part defined by cutting the other side disposed opposite to the one side of the lower end in an upwardly convex shape; and a pair of peak parts disposed between the first and second inclined cutoff parts and spaced apart from each other.

The flange part may include a first flange extending radially outward from the outer circumferential surface of the drain pipe; and a second flange extending radially outward from the outer circumferential surface of the first flange and having a thickness greater than that of the first flange.

A coupling stepped portion may be disposed on a bottom surface of the second flange so as to be seated and coupled to the drain pan.

The drain guide part may further include a reinforcing rib that protrudes from an upper portion of the first flange and has a hollow communicating with the drain pipe therein.

The reinforcing rib may have a top surface facing upward; and a curved inner surface disposed around the hollow, wherein the inner circumferential surface is curved so that a cross-sectional area of the hollow gradually decreases downward, wherein the top surface and the curved inner surface may form one surface.

The drain guide part may protrude from an upper end of the reinforcing rib and may further include one or more support bar insertion parts provided to allow the cover support bar to be inserted and supported.

The reinforcing rib may be provided in a ring shape, and the support bar insertion part may be spaced at regular intervals along the reinforcing rib so as to be provided in plurality, and the cover support bar may be provided in plurality to correspond to the support bar insertion part.

The drain cover may have a top surface that is convex upward, and a lower surface may be concave upward.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Hereinafter, it should be understood that the exemplary embodiments herein are provided only for the illustrative purpose, and various modifications of the embodiments are reproduced. However, detailed descriptions related to well-known functions or configurations will be ruled out in order not to unnecessarily obscure subject matters of the present disclosure, and the detailed descriptions and specific illustrations will be omitted. In addition, the shapes and the sizes of elements in accompanying drawings will be exaggerated for more apparent description.

It will be understood that although the terms of first and second are used in this specification to describe various elements, these elements should not be limited by these terms. These expressions may be used to distinguish one component from another component.

In the following description, the technical terms are used only for explaining a specific exemplary embodiment while not limiting the scope of rights. The terms of a singular form may include plural defines unless referred to the contrary. In this application, the terms "comprises" or "having" are intended to indicate that there is a feature, number, step, operation, component, part, or combination thereof described in the specification, and one or more other features. It is to be understood that the present disclosure does not exclude the possibility of the presence or the addition of numbers, steps, operations, components, components, or a combination thereof.

Figure 1:
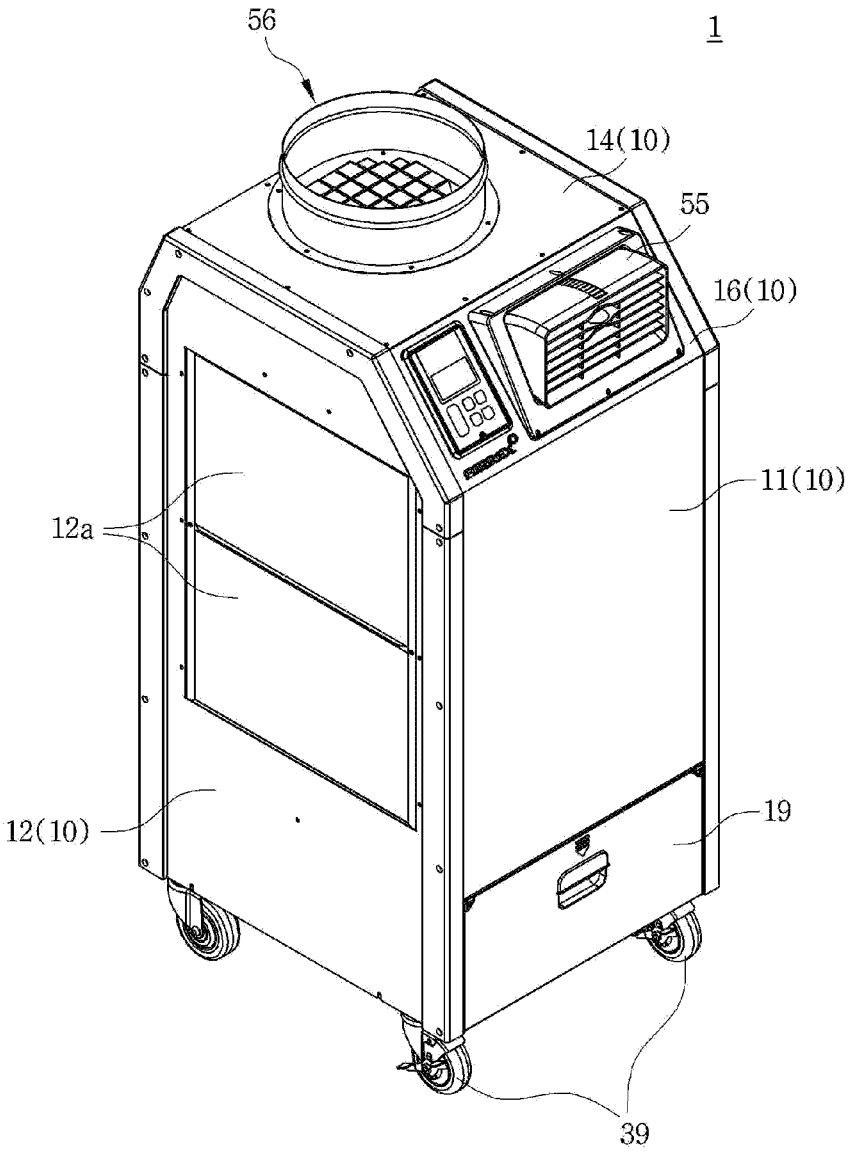
FIGS. 1 and 2 are perspective views of a portable air conditioner according to an embodiment of the present disclosure.
Figure 2:
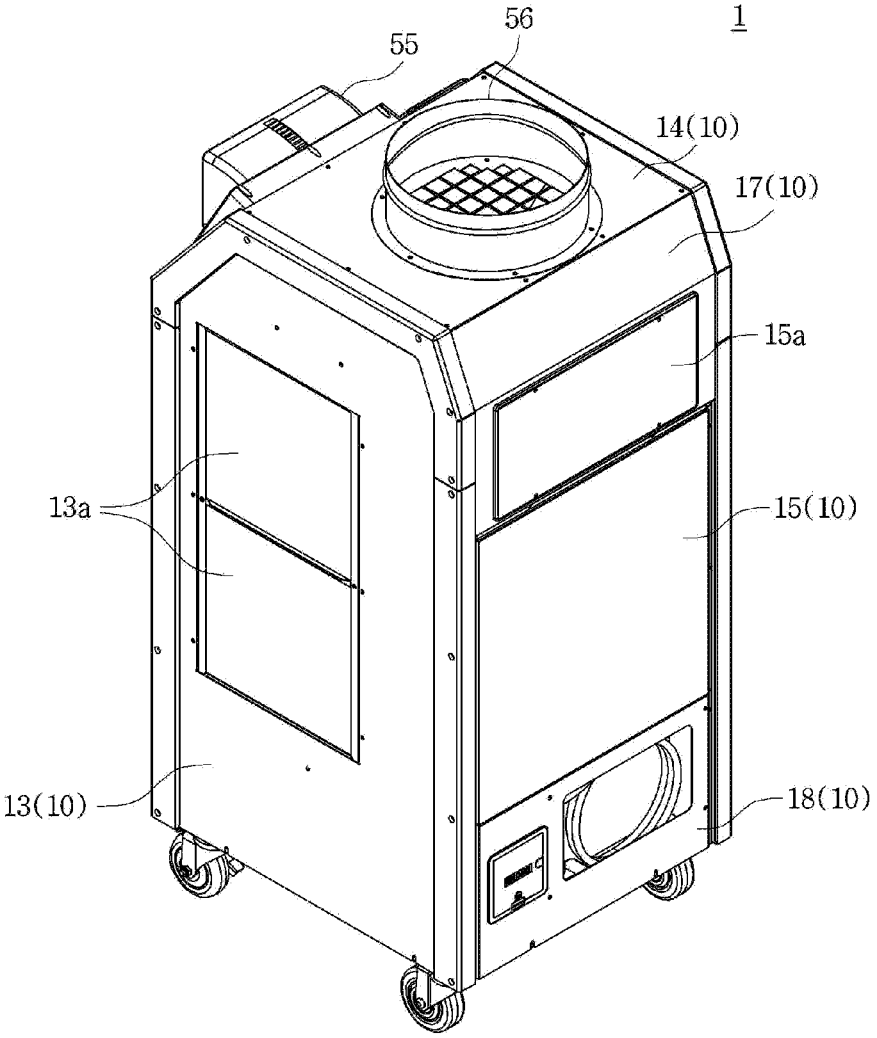

Hereinafter, a portable air conditioner 1 according to an embodiment of the present disclosure will be described with reference to FIGS. 1 and 2. FIGS. 1 and 2 are perspective views of a portable air conditioner 1 according to an embodiment of the present disclosure.

Referring to FIGS. 1 and 2, the portable air conditioner 1 according to an embodiment of the present disclosure includes a housing 10, heat exchangers 21 and 22, a passage partition module 100, and a blower fan 50.

The housing 10 defines an outer appearance, and an internal space is defined therein. In the internal space, an upper space defines a heat exchange chamber, and the lower space defines a machine room 19*c*. The housing 10 includes an upper panel 14, a front panel 11, a rear panel 15, a lower panel (not shown), a first side panel 13 connecting the front panel 11 to the rear panel 15, a front inclined panel 16 connecting the upper panel 14 to the front panel 11, and a rear inclined panel 17 connecting the upper panel 14 to the rear panel 15.

The upper panel 14 defines a top surface of the housing 10, the front panel 11 defines a front surface of the housing 10, the rear panel 15 defines a rear surface of the housing 10, the lower panel (not shown)) defines a bottom surface of the housing 10, the first side panel 13 defines a first side surface 13 of the housing 10, and the second side panel 12 defines a second side surface 12 of the housing 10, which is disposed at an opposite side of the first side surface 12 of the housing 10.

The upper panel 14 is connected to each of an upper end of the front inclined panel 16, upper ends of the first side panel 13 and the second side panel 12, and an upper end of the rear panel 15 and is provided with an upper discharge part 56 communicating with the heat exchange chamber.

The front panel 11 is connected to each of a lower end of the front inclined panel 16 and front ends of the first side panel 13 and the second side panel 12.

The rear panel 15 is connected to each of a lower end of the rear inclined panel 17, rear ends of the first side panel 13 and the second side panel 12, and a rear end of the lower panel.

The lower panel is connected to each of a lower end of the front panel 11, lower ends of the first side panel 13 and the second side panel 12, and a lower end of the rear panel 15.

The first side panel 13 defines the first side surface 13 of the housing 10 and is connected to each of one end of the front panel 11, one end of the front inclined panel 16, one end of the upper panel 14, one end of the rear panel 15, and one end of the lower panel.

The first side panel 13 is provided with a first inlet 13*a* that allows the heat exchange chamber to communicate with the outside. A member capable of removing foreign substances from external air such as a filter may be installed in the first inlet 13*a*.

The second side panel 12 is spaced a predetermined distance from the first side panel 13 to face each other and defines a second side surface disposed at an opposite side of the first side surface 13 of the housing 10. The second side panel 12 is connected to each of the other end of the front panel 11, the other end of the front inclined panel 16, the other end of the upper panel 14, the other end of the rear panel 15, and the other end of the lower panel.

The second side panel 12 is provided with a second inlet 12*a* that allows the heat exchange chamber to communicate with the outside. A member capable of removing foreign substances from the external air such as a filter may be installed in the second inlet 12*a*.

The front inclined panel 16 is surrounded by the upper panel 14, the front panel 11, the first side panel 13, and the second side panel 12, is connected to each of the upper panel 14, the front panel 11, the first side panel 13, and the second side panel 12, and is provided to be inclined downward to face a front side. The front inclined panel 16 is provided with a first through-hole communicating with the heat exchange chamber and second through-holes 16*b* and 16*c* communicating with an accommodation part 115 disposed at one side of the first through-hole 16*a* and to be described later. The first through-hole 16*a* is provided with a front discharge part 55, and the front discharge part 55 guides air discharged through the first through-hole 16*a* to a front side.

The rear inclined panel 17 is surrounded by the upper panel 14, the rear panel 15, the first side panel 13, and the second side panel 12, is connected to each of the upper panel 14, the rear panel 15, the first side panel 13, and the second side panel 12, and is provided to be inclined downward toward a rear side.

In general, when a duct is connected to the portable air conditioner to extend to be inclined upward, the portable air conditioner is provided in plurality, and when the plurality of portable air conditioners are densely disposed in a forward and backward direction, the duct and the housing 10 has to be spaced a predetermined distance from each other due to an interference therebetween.

However, as in one embodiment of the present disclosure, in the portable air conditioner 1 provided with the rear inclined panel 17, the mutual interference may be minimized, and thus, the plurality of portable air conditioners 1 may be disposed to be in contact with each other in the forward and backward direction.

In the heat exchange chamber, the external air introduced into the housing 10 is heat-exchanged. The heat exchange chamber is surrounded by the front panel 11, the upper panel 14, the rear panel 15, the front inclined panel 16, the rear inclined panel 17, the first side panel 13, and the second side panel 12.

The heat exchange chamber includes a front part adjacent to the front panel 11, an upper part adjacent to the upper panel 14, a rear part adjacent to the rear panel 15, a first side part adjacent to the first side panel 13, and a second side part adjacent to the second side panel 12.

The heat exchange chamber includes first heat exchange chambers 130*a*, 130*b*, and 130*c* in which the external air introduced through the first inlet 13*a* is cooled, and second heat exchange chambers 140*a*, 140*b*, and 140*c* in which the external air introduced through the second inlet 12*a* is heated. Each of the first heat exchange chambers 130*a*, 130*b*, and 130*c* and the second heat exchange chambers 140*a*, 140*b*, and 140*c* may cool or heat the external air by selectively setting a refrigerant circulation direction of a heat pump to either the forward direction or reverse direction, and each heat exchange chamber is not limited to perform only one function of the cooling of the external air and the heating of the external air.

The machine room 19*c* is disposed at a lower portion of the heat exchange chamber to provide a space in which a compressor 23 that operates an air conditioning cycle, a portion of a refrigerant pipe 24, and a water tank 300 that stores the condensate are disposed.

Figure 3:
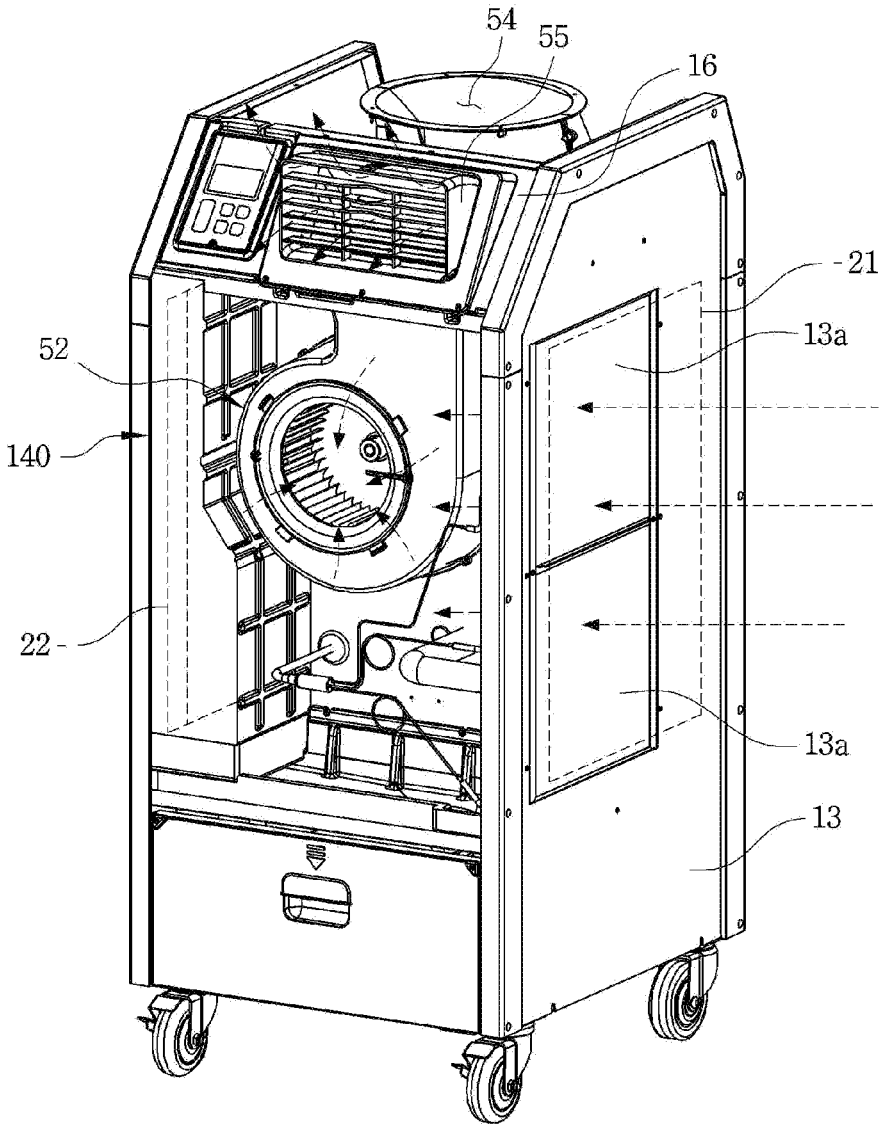
FIGS. 3 and 4 are views for explaining a passage provided in the portable air conditioner illustrated in FIG. 1.
Figure 4:
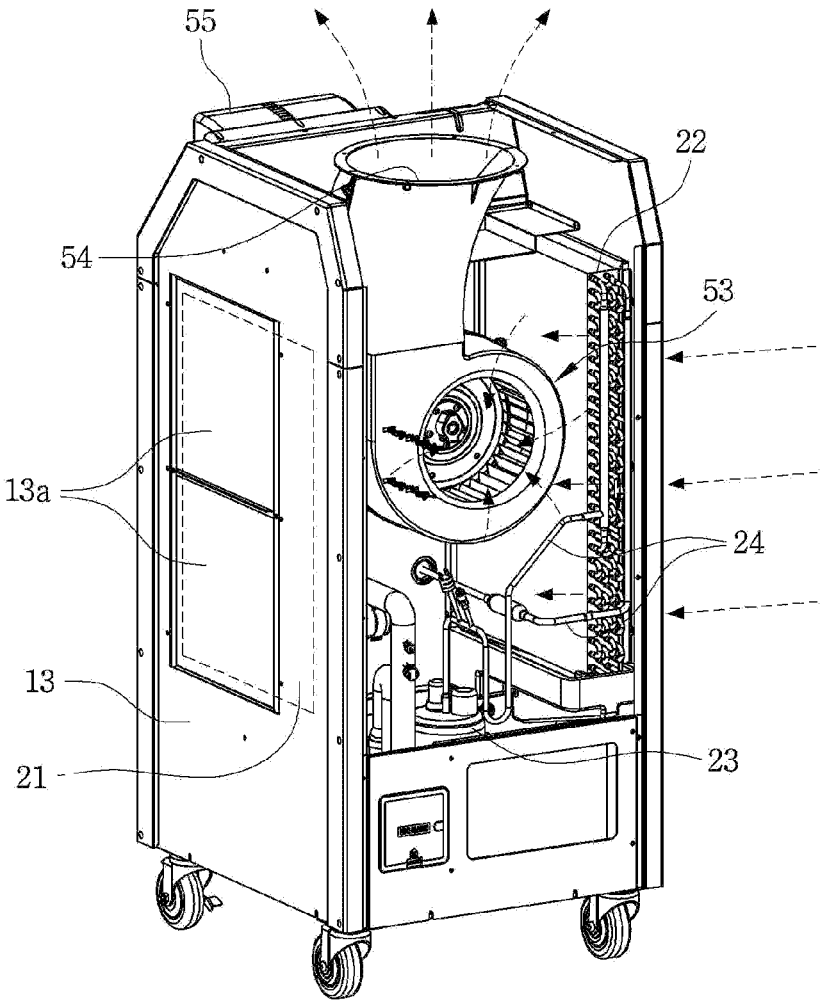

Hereinafter, a passage of the portable air conditioner 1 according to an embodiment of the present disclosure will be described with reference to FIGS. 3 to 5. FIGS. 3 and 4 are views for explaining a passage provided in the portable air conditioner illustrated in FIG. 1, and FIG. 5 is a perspective view of the blower fan illustrated in FIG. 4.

Figure 5:
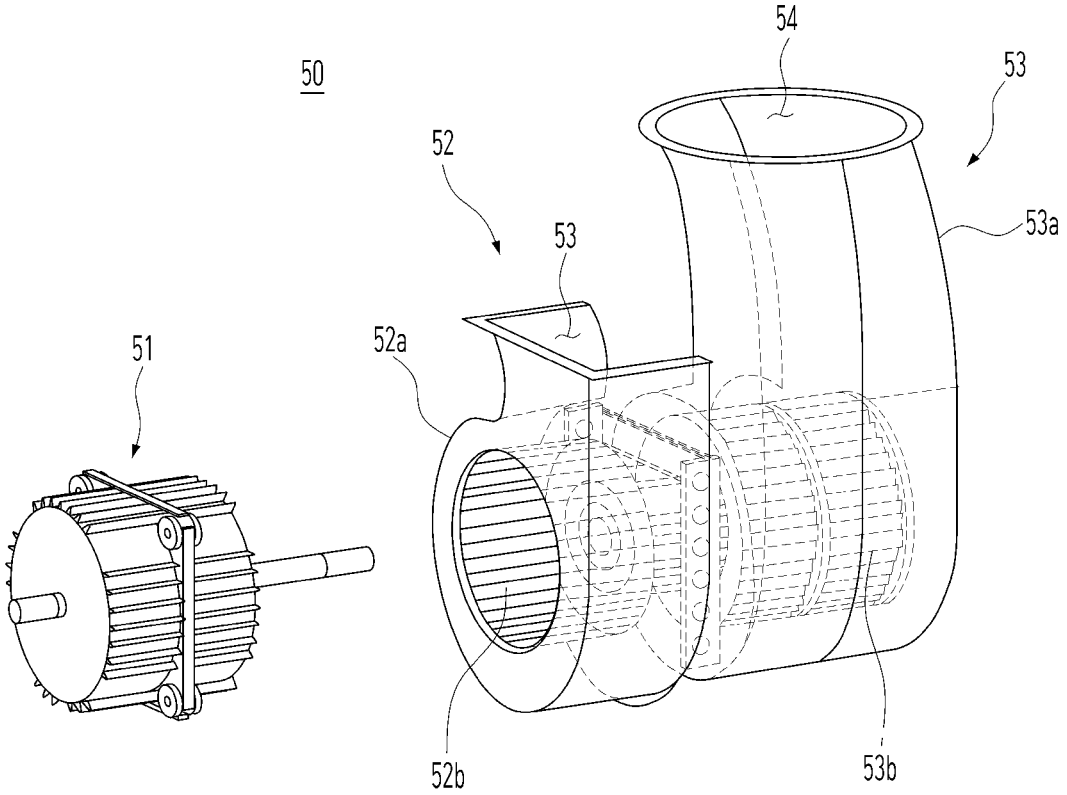
FIG. 5 is a perspective view of a blower fan illustrated in FIG. 4.

Referring to FIGS. 3 and 5, the passage of the portable air conditioner 1 includes a cold air passage and a hot air passage.

The cold air passage is provided along an arrow as illustrated in FIG. 3. The external air is introduced through the first inlet 13*a* provided in the first side panel 13. Then, the external air is heat-exchanged with a first heat exchanger 21 provided adjacent to the first side panel 13 and then moves upward by a first fan 52 and is discharged forward through the front discharge part 55. The cold air passage represents this flow of the external air.

The hot air passage is provided along an arrow as illustrated in FIG. 4. The external air is introduced through the second inlet 12*a* provided in the second side panel 12. Then, the external air is heat-exchanged with a second heat exchanger 22 provided adjacent to the second side panel 12 and then moves upward by a second fan 53 disposed behind the first fan 52 and is discharged upward through the upper discharge part 55. The hot air passage represents this flow of the external air.

The cold air passage and the hot air passage are not fixed, and as described above, the circulation direction of the refrigerant passing through the compressor 23, condensers 21 and 22, evaporator 21 and 22, and an expander that constitutes the heat pump is changed depending on whether the forward or reverse direction is selected. Thus, the first heat exchanger 21 may serve as the evaporator, and the second heat exchanger 22 may serve as the condenser, or the first heat exchanger 21 may serve as the condenser, and the second heat exchanger 22 may serve as an evaporator.

The blower fan 50 includes a first fan 52 by which the external air is introduced into the first heat exchangers 130*a*, 130*b*, and 130*c* and then is discharged to the outside, a second fan 53 by which the external air is introduced into the second heat exchangers 140*a*, 140*b*, and 140*c* and then is discharged to the outside, and a blower fan 51 that drives the first fan 52 and the second fan 53.

The first fan 52 includes a first fan blade 52*b* that collides with air to allow the air to moves, a first fan casing 52*a* accommodating the first fan blade 52*b*, and a first fan discharge pipe 53 that guides the air moving by the first fan blade 52*b* upward. The external air is introduced from a front side of the first fan 52 and then is discharged upward.

The second fan 53 includes a second fan blade 53*b* that collides with air to allow the air to moves, a second fan casing 53*a* accommodating the second fan blade 53*b*, and a second fan discharge pipe 54 that guides the air moving by the second fan blade 53*b* upward. The external air is introduced from a rear side of the second fan 53 and then is discharged upward.

A blowing motor 51 is disposed between the first fan 52 and the second fan 53, is connected to each of the first fan blade 52*b* and the second fan blade 53*b* through each rotation shaft, and transmits driving force to allow the first fan blade 52*b* and the second fan blade 53*b* to rotate.

As the first fan 52 and the second fan 53 are provided at both ends of the rotation shaft of the blowing motor 51, the first fan 52, the second fan 53, and the blowing motor 51 are aligned in the forward and backward direction. The rotation shaft of the blowing motor 51 passes through a partition wall 150, and a self-weight of the blower fan 50 is supported by the partition wall 150.

Figure 6:
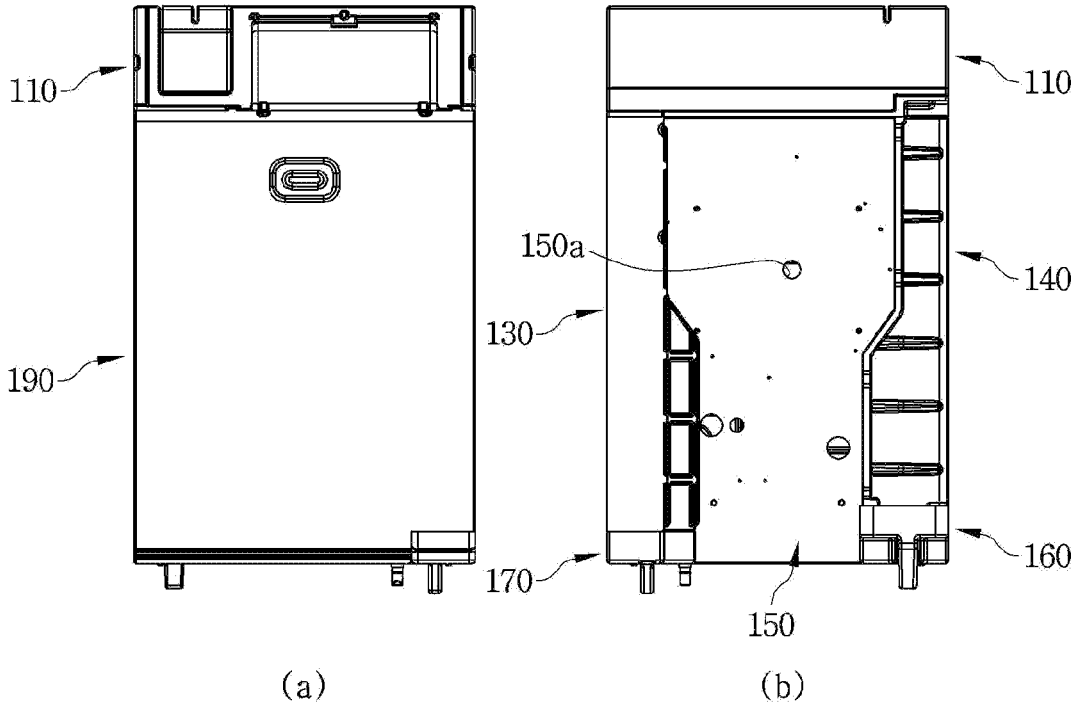
FIG. 6 is a front and rear view of a passage partition module provided inside a housing to define a passage that guides cold air and hot air.
Figure 7:
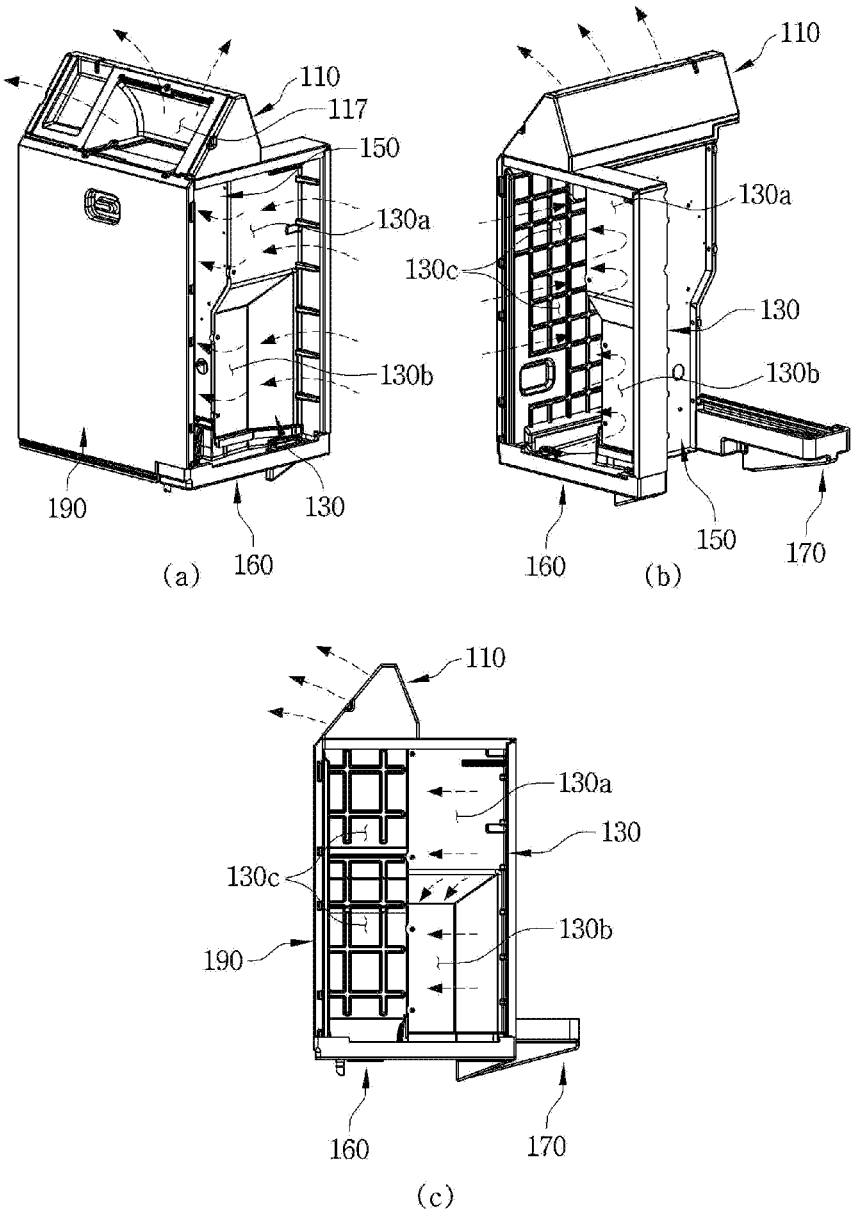
FIGS. 7 and 8 are views for explaining the passage partitioned by the passage partition module illustrated in FIG. 6.
Figure 8:
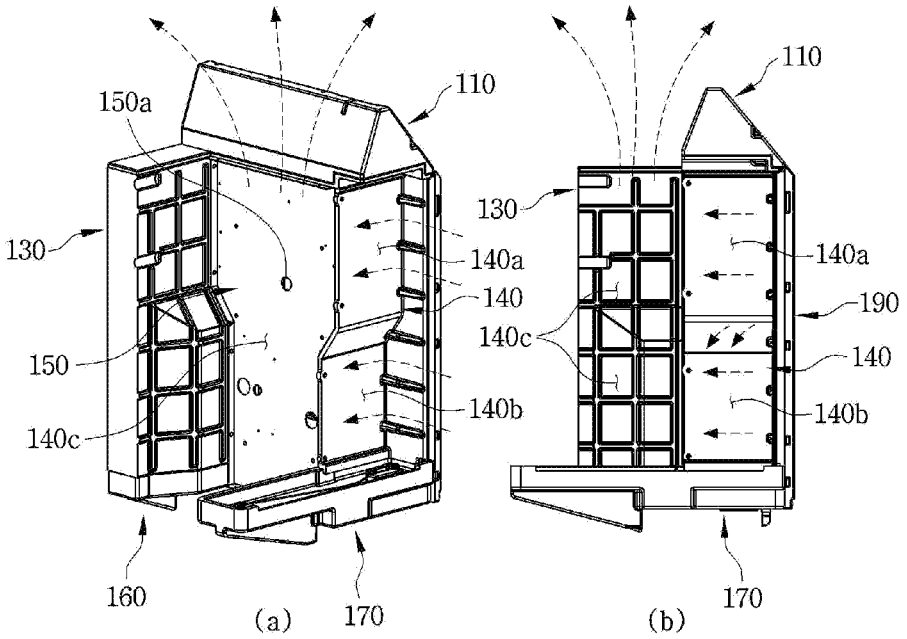
Figure 9:
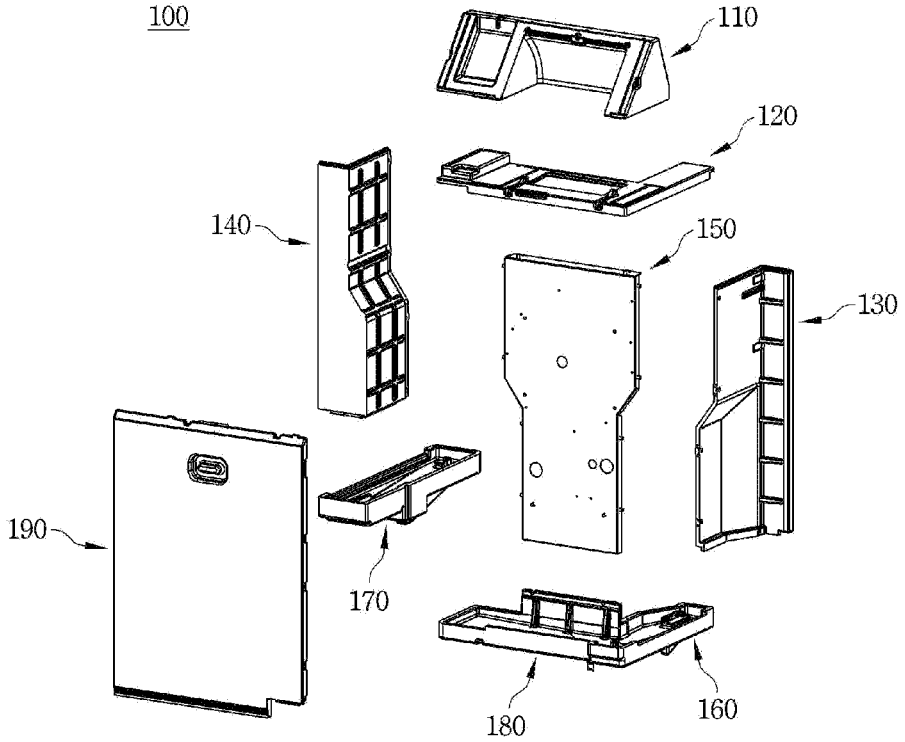
FIG. 9 is an exploded perspective view of the passage partition module illustrated in FIG. 6.

Hereinafter, a passage partition module 100 will be described with reference to FIGS. 6 to 8. FIG. 6 is a front and rear view of the passage partition module 100 provided inside the housing 10 to define the passage that guides cold air and hot air, FIGS. 7 and 8 are views for explaining the passage partitioned by the passage partition module 100 illustrated in FIG. 6, and FIG. 9 is an exploded perspective view of an arrangement relationship of components constituting the passage partition module 100 illustrated in FIG. 6.

Referring to FIGS. 6 to 9, the passage partition module 100 divides the heat exchange chamber into the first heat exchange chambers 130*a*, 130*b*, and 130*c* and the second heat exchange chambers 140*a*, 140*b*, and 140*c* to provide the cold air passage and the hot air passage.

The passage partition module 100 includes a first guide part 130, a partition wall 150, a second guide part 140, a front cover 190, an inner casing 110, a casing support 120, and drain pans 160, 170, and 180. The first heat exchange chambers 130*a*, 130*b*, and 130*c* and the second heat exchange chambers 140*a*, 140*b*, and 140*c* are partitioned by the first guide part 130, the partition wall 150, the second guide part 140, the casing support 120, the drain pans 160, 170, and 180.

The first heat exchange chambers 130*a*, 130*b*, and 130*c* include a first heat exchange chamber front part 130*c* and first heat exchange chamber side parts 130*a* and 130*b*.

The first heat exchange chamber front part 130*c* defines a front portion, i.e., the front of the heat exchange chamber. The first heat exchange chamber front part 130*c* includes a space defined between the partition wall 150, the second guide part 140, the casing support 120, the front cover 190, and the drain pans 160 and 180, and the first fan 52 is provided in the space.

The first heat exchange chamber front part 130*c* communicates with the machine room 19*c* through a condensate discharge port 184, which will be described later, and communicates with a front discharge passage 117 of the inner casing 110 through a first passage communication groove 123 of the casing support 120.

The first heat exchange chamber side parts 130*a* and 130*b* define a first side portion, that is, the first side part of the heat exchange chamber. The first heat exchange chamber side parts 130*a* and 130*b* communicate with the first heat exchange chamber front part 130*c* and include a space defined between the first guide part 130, the casing support 120, the first side panel 13, and the first drain pan 160, and a portion of the first heat exchanger 21 is disposed in the space.

When the first fan 52 operates, a negative pressure is generated in the first heat exchange chambers 130*a*, 130*b*, and 130*c*, and the external air is introduced from the first inlet 13*a*. The introduced external air is changed in movement direction forward by the first guide part 130 and then is introduced into the first fan 52 to move upward and is introduced into the front discharge passage 117 of the inner casing 110.

The second heat exchange chambers 140*a*, 140*b*, and 140*c* include a second heat exchange chamber rear part 140*c* and second heat exchange chamber side parts 140*a* and 140*b*.

The second heat exchange chamber rear part 140*c* defines a rear portion, i.e., the rear part of the heat exchange chamber. The second heat exchange chamber rear part 140*c* includes a space defined between the first guide part 130, the partition wall 150, the upper panel 14, and the rear panel 15, and the second fan 53 is provided in the space. The second heat exchange chamber rear part 140*c* communicates with the machine room 19*c*.

The second heat exchange chamber side parts 140*a* and 140*b* define a side portion, i.e., the second side part of the heat exchange chamber and are disposed at an opposite side of the first heat exchange chamber side parts 130*a* and 130*b*. The second heat exchange chamber side parts 140*a* and 140*b* communicate with the second heat exchange chamber rear part 140*c* and include a space defined between the second guide part 140, the second side panel 12, and the second drain pan 170, and the second heat exchanger 22 is provided in the space.

When the second fan 53 operates, a negative pressure is generated in the second heat exchange chambers 140*a*, 140*b*, and 140*c*, and the external air is introduced from the second inlet 12*a*. The introduced external air is changed in movement direction backward by the second guide part 140 and then is introduced into the second fan 53 to move upward and is discharged to the outside through the upper discharge part 56 of the upper panel 14.

The portable air conditioner according to the related art uses one motor and two fans connected to both ends of a rotation shaft of the motor so that the external air is introduced. The motor and the two fans are aligned in the forward and backward direction and installed in the portable air conditioner.

In addition, one heat exchanger is installed in front and behind the two fans. A relatively easy method is applied to divide the internal space of the portable air conditioner into front and rear spaces, and the external air introduced by each fan is not mixed, but is discharged to the outside as cold and hot air. However, the portable air conditioner has a limitation of low space utilization due to the very long front and rear distance.

As described above, in the portable air conditioner 1 according to an embodiment of the present disclosure, both the first heat exchanger 21 and the second heat exchanger 22 are not provided in front and behind the blower fan 50, but are disposed at both sides, and thus, a front and rear distance of the portable air conditioner 1 is minimized.

In addition, each of the first heat exchanger 21 and the second heat exchanger 22 is disposed adjacent to the blower fan 50 to minimize a left and right distance of the portable air conditioner 1.

In addition, to minimize air resistance due to the adjacent arrangement, the blower fan 50 is disposed at an upper end of the partition wall 150, and a lower space of each of the first heat exchange chamber side parts 130*a* and 130*b* and the second heat exchange chamber side parts 140*a* and 140*b* is greater than an upper space thereof.

In addition, as the blower fan 50 is seated and supported on an inclined surface of an inner surface of the lower space of each of the first heat exchange chamber side parts 130*a* and 130*b* and the second heat exchange chamber side parts 140*a* and 140*b*, the blower fan 50 is additionally supported.

Hereinafter, each component constituting the passage partition module 100 will be described with reference to FIGS. 9 to 15. FIG. 9 is an exploded perspective view of the passage partition module 100 illustrated in FIG. 6, and FIGS. 10 to 15 are view for explaining each components constituting the passage partition module 100 illustrated in FIG. 6.

Figure 10:
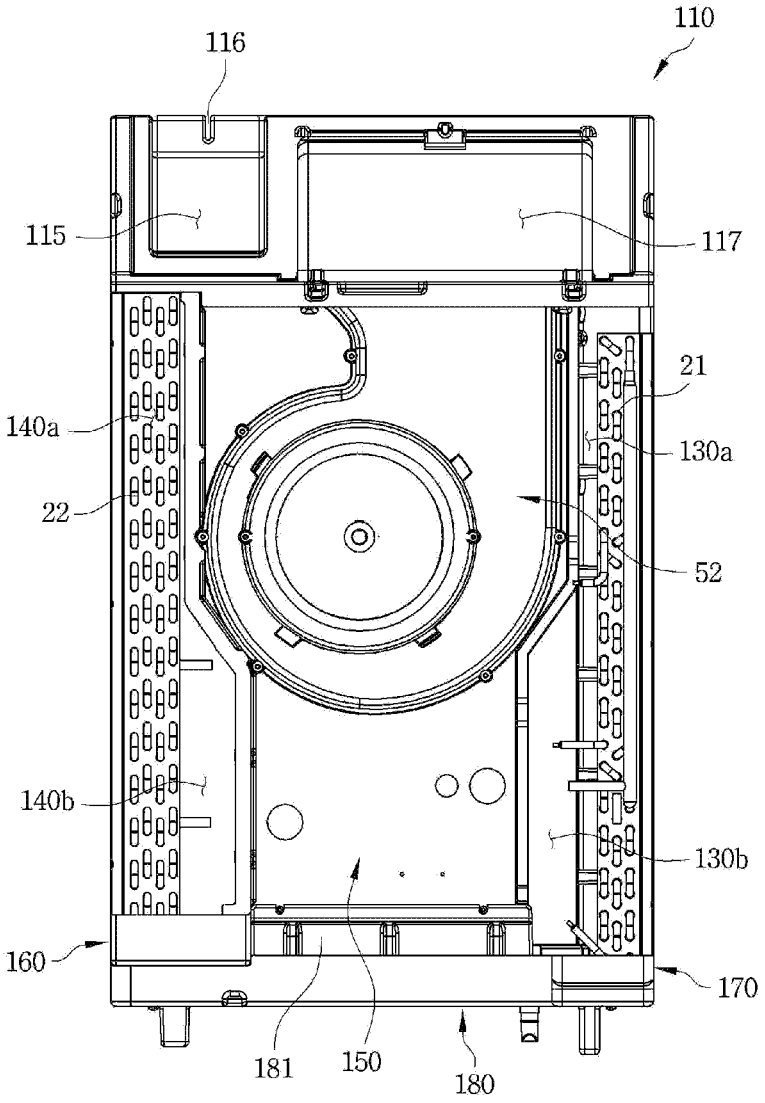
FIGS. 10 to 15 are view for explaining each components constituting the passage partition module illustrated in FIG. 6.

As shown in FIGS. 9 and 10, the passage partition module 100 includes the inner casing 110, the casing support 120 supporting the inner casing 110, the first guide part 130, the second guide part 140, the partition wall 150, the drain pans 160, 170, and 180, and the front cover 190.

Hereinafter, the inner casing 110 and the casing support 120 will be described with reference to FIG. 11.

The inner casing 110 defines an upper end of the passage partition module 100 and includes a casing front surface 111, a casing rear surface 112, and a pair of casing side surfaces 113.

The casing front surface 111 is provided to be inclined downward toward the front side. The casing front surface 111 is disposed at the other side, which is opposite to one side, of the accommodation part 115 of which the one side is recessed, and an opening communicating with the front discharge passage 117 is defined in the casing front surface 111.

An upper end of the casing rear surface 112 is connected to an upper end of the casing front surface 111 to define a predetermined angle and is inclined downward toward the rear side. A rear space of the casing rear surface 112 communicates with the second heat exchange chambers 140*a*, 140*b*, and 140*c*.

The pair of casing side surfaces 113 connect both ends of the casing front surface 111 and the casing rear surface 112 to each other.

The inner casing 110 may further include a casing top surface 114.

The casing top surface 114 is disposed at a portion at which the casing front surface 111 and the casing rear surface 112 are connected to each other and has a predetermined area. The casing top surface 114 may be provided with a communication groove 116 defined as one side thereof is recessed downward.

The communication groove 116 communicates with a rear space of the casing rear surface 112 and is affected by a pressure of each of the second heat exchange chambers 140*a*, 140*b*, and 140*c*.

The inner casing 110 has the front discharge passage 117 defined therein. The front discharge passage 117 is curved to discharge the external air moving upward by the first fan 52 to be inclined upward toward the front side. For this, the inner casing 110 is provided with a passage curved surface 117*a* therein. The passage curved surface 117*a* collides with the external air moving upward by the first fan 52 to guides external air forward and is curved to minimize the resistance applied to the external air.

The casing support 120 supports the self-weight of the inner casing 110, and for this purpose, the top surface is coupled to the lower end of the inner casing 110. The casing support 120 serves as a ceiling of a portion of the first heat exchange chambers 130*a*, 130*b*, and 130*c* and the second heat exchange chambers 140*a*, 140*b*, and 140*c*, and for this, a bottom surface of the casing support 120 is coupled to the first guide part 130, the second guide part 140, and an upper end of the partition wall 150.

This casing support 120 includes a first casing support frame 125 and a second casing support frame 122 connected to the first casing support frame 125.

The first casing support frame 125 extends in a left and right direction and has one side at which a second guide part cover is disposed and the other side through which the first passage communication groove 123 communicating with the front discharge passage 117 passes. The inner casing 110 is seated on the first casing support frame 125.

The second casing support frame 122 extends backward from the first casing support frame 125 so as to be the upper end of the first guide part 130.

A longitudinal direction of the first casing frame 125 and a longitudinal direction of the second casing support frame 122 cross each other, and thus, a second passage communication groove 124 is defined between an inner surface of the first casing support frame 125 and an inner surface of the second casing support frame 122, and the second passage communication groove 124 communicates with the second heat exchange chambers 140*a*, 140*b*, and 140*c*.

Figure 12:
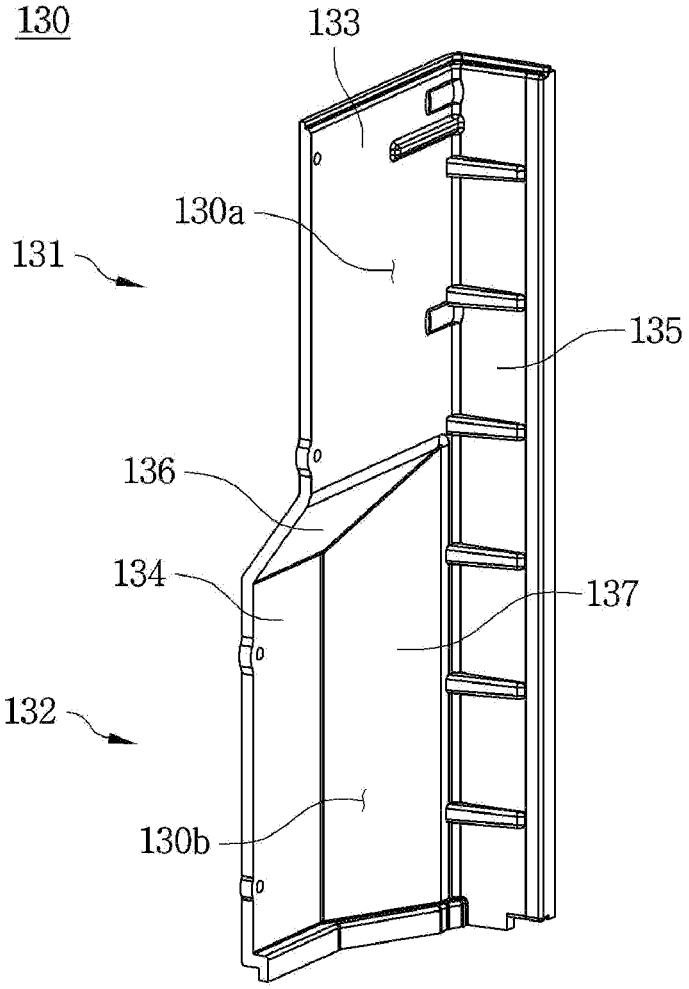

Hereinafter, the first guide part 130 will be described with reference to FIG. 12.

The first guide part 130 is provided at the first side part of the heat exchange chamber to guide the external air introduced through the first inlet 13*a* to the front part of the heat exchange chamber.

The first guide part 130 includes a first upper end guide part 131 defining a first space 130*a* together with the first side surface of the housing and a first lower end guide part 132 provided below the first upper end guide part 131 to define a second space 130*b* together with the first side surface of the housing 10. The second space 130*b* communicates with the first space 130*a* and has a volume greater than that of the first space 130*a*. The first space 130*a* and the second space 130*b* together accommodate the first heat exchanger 21.

The first guide part 130 includes a first upper plate 133 facing the first side surface 13 of the housing 10, a first lower plate 134 facing the first side surface 13 of the housing 10 and provided below the first upper plate 133, a rear plate 135 coupled to the first upper plate 133 at a predetermined angle, a first inclined plate 136 connecting the first upper plate 133 to the first lower plate 134 and provided to be inclined downward toward the inside of the housing 10, and a second inclined plate 137 connecting the first lower plate 134 to the rear plate 135 and provided to be inclined forward toward the inside of the housing 10.

The first upper plate 133 and an upper end of the rear plate 135 define the first upper end guide part 131, and the first lower plate 134, the first inclined plate 136, the second inclined plate 137, and a lower end of the rear plate 135 define the first lower end guide part 132.

The first lower plate 134 is spaced farther from the first side surface 13 of the housing 10 than the first upper plate 133, and the second space 130*b* has a volume larger than that of the first space 130*a*.

The first inclined plate 136 and the second inclined plate 137 are provided in a direction inclined with respect to the inflow direction of the external air introduced through the first inlet 13*a*, and when the inflow direction of the external air is finally changed to the front side, resistance of the external air is minimally applied.

Figure 13:
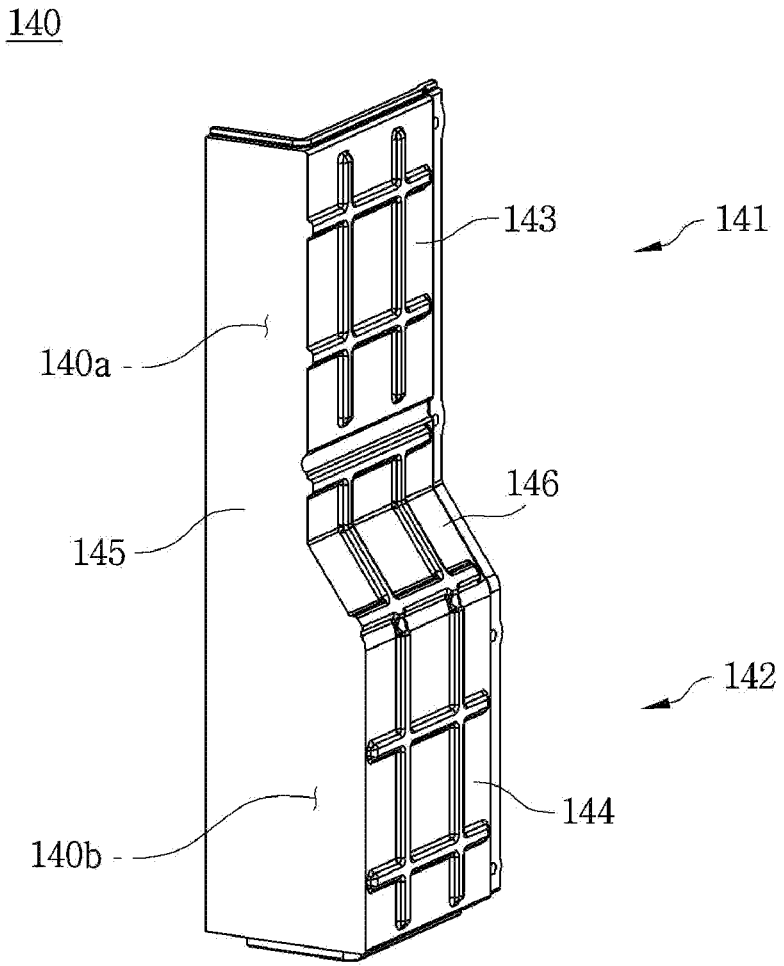

Hereinafter, the second guide part 140 will be described with reference to FIG. 13. The second guide part 140 is provided at the second side part disposed at an opposite side of the first side part of the heat exchange chamber to guide the external air introduced through the second inlet 12*a* to the rear part of the heat exchange chamber.

The second guide part 140 includes a second upper end guide part 141 defining a third space 140*a* together with the second side surface 12 of the housing and a second lower end guide part 142 provided below the second upper end guide part 141 to define a fourth space 140*b* together with the second side surface of the housing 10. The fourth space 140*b* communicates with the third space 140*a* and has a volume greater than that of the third space 140*a*. The third space 140*a* and the fourth space 140*b* together accommodate the second heat exchanger 22.

The second guide part 140 includes a second upper plate 143 facing the second side surface 12 of the housing 10, a second lower plate 144 facing the second side surface 12 of the housing 10 and provided below the second upper plate 143, a front plate 145 coupled to each of the second upper plate 143 and the second lower plate 144 at a predetermined angle, and a third inclined plate 146 connecting the second upper plate 143 to the second lower plate 144, provided to be inclined downward toward the inside of the housing 10, and coupled to the front plate 145.

The second upper plate 143 and a lower end of the front plate 145 define a second upper end guide part 141, and a lower end of the front plate 145, the third inclined plate 146, and the second lower plate 144 define a second lower end guide part 142.

The second lower plate 144 is spaced farther from the second side surface 12 of the housing 10 than the second upper plate 143, and the fourth space 140*b* has a volume greater than that of the first space 140*a*.

The third inclined plate 146 is provided in a direction inclined with respect to the inflow direction of the external air introduced through the second inlet 12*a*, and when the inflow direction of the external air is changed, resistance of the external air is minimally applied.

A spaced distance between the first upper end guide part 131 and the second upper end guide part 141 is less than that between the first lower end guide part 132 and the second lower end guide part 142.

The first inclined plate 136 may be provided to support the first fan 52, and the third inclined plate 146 may be provided to support the second fan 53, but is limited thereto.

Figure 14:
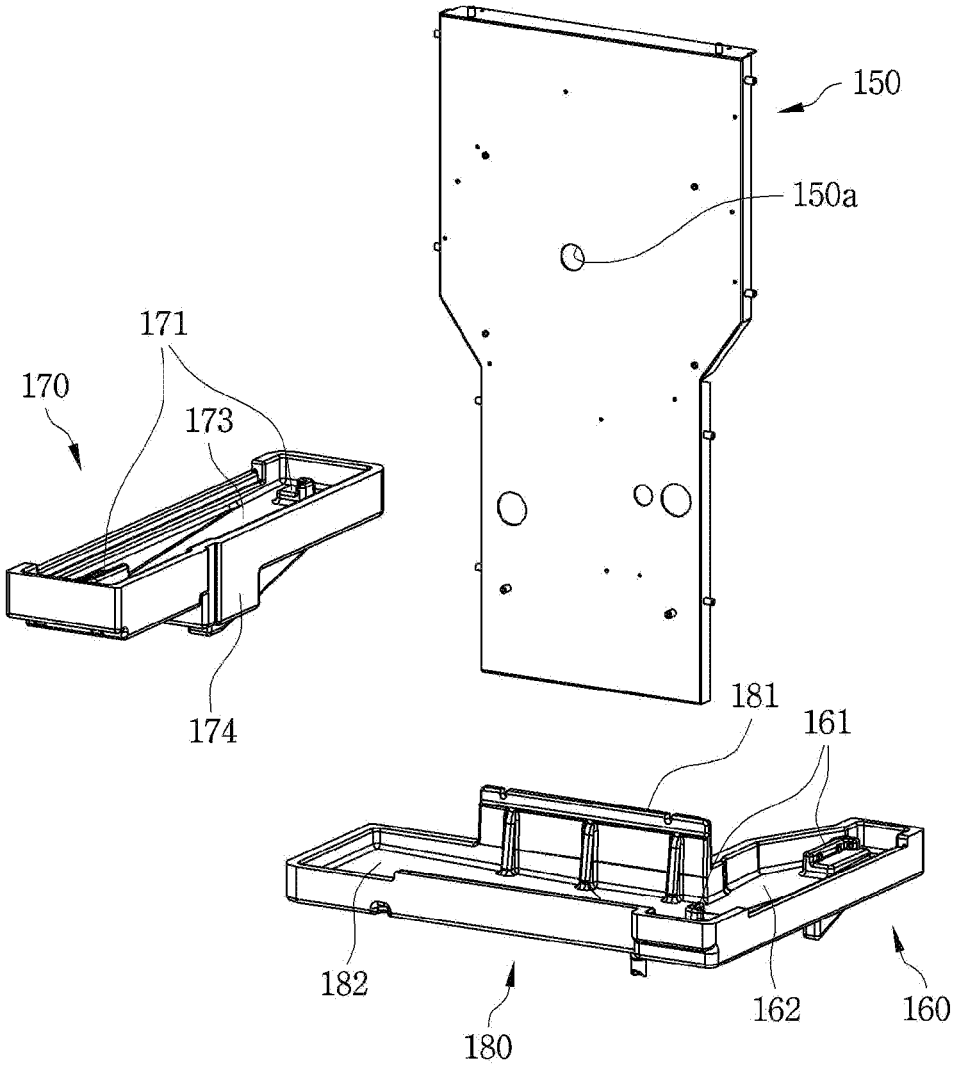
Figure 15:
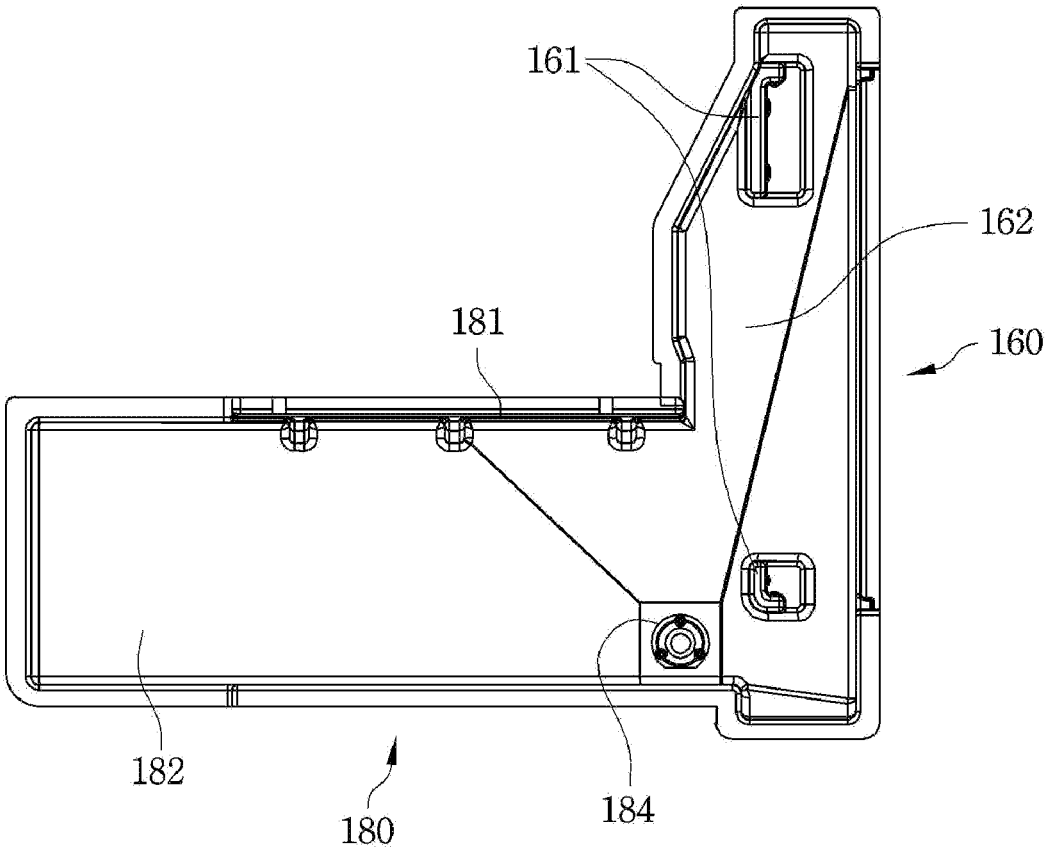

Hereinafter, the partition wall 150 and the drain pans 160, 170, and 180 will be described with reference to FIGS. 14 and 15.

The partition wall 150 is provided between the first guide part 130 and the second guide part 140 to prevent the external air guided to the heat exchange chamber front part by the first guide part 130 and the external air guided to the heat exchange chamber rear part by the second guide part 140 from being mixed with each other.

The partition wall 150 has both side surfaces having shapes corresponding to the shapes of the first guide part 130 and the second guide part 140. Thus, a width of an upper end of the partition wall 150 is larger than that of a lower end thereof, and air in the first heat exchange chambers 130*a*, 130*b*, and 130*c* and air in the second heat exchange chambers 140*a*, 140*b*, and 140*c* are prevented from being mixed with each other.

A fan coupling hole 150*a* is defined to pass through the upper end of the partition wall 150 so that the blower fan 50 is installed, and a plurality of coupling holes are defined in the lower end of the partition wall 150 so that a partition wall support 181 to be described later is coupled and supported.

The drain pans 160, 170, and 180 collect condensate generated in the heat exchangers 21 and 22. The drain pans

160, 170, and 180 include a first drain pan 160, a second drain pan 170, and a third drain pan 180.

The first drain pan 160 is provided below the first heat exchanger 21 to collect the condensate generated in the first heat exchanger 21. The first drain pan 160 extends in the forward and backward direction, and a first bottom part 162 is provided to be inclined downward toward the front side.

The first drain pan 160 is provided with a pair of first heat exchange supports 161 protruding from a front end and a rear end of the first bottom part 162 so that the first heat exchanger 21 is seated and supported.

The second drain pan 170 is provided below the second heat exchanger 22 to collect the condensate generated in the second heat exchanger 22, thereby discharging the condensate downward. The second drain pan 170 extends in the forward and backward direction, and a second bottom part 173 is provided to be inclined downward toward the front side.

The second drain pan 170 is provided with a pair of second heat exchange supports 171 protruding from a front end and a rear end of the second bottom part 173 so that the second heat exchanger 22 is seated and supported.

The second drain pan 170 is seated on the third drain pan 180 and protrudes from a lower portion of the drain pan protrusion 174 so as to be seated at an accurate point.

The third drain pan 180 communicates with the first drain pan 160 to collect the condensate introduced from the first drain pan 160 and the condensate discharged from the second drain pan 170 to drop, thereby discharging the condensate downward.

The third drain pan 180 extends in the left and right direction, is provided to be inclined downward from the second drain pan 170 toward the first drain pan 160, and has a condensate discharge port 184 so that the condensate is discharged downward.

The third drain pan 180 is provided to seat and support the second drain pan 170, and the second drain pan 170 has a groove into which the partition wall support 181 is inserted so that the third drain pan 180 is firmly coupled.

The partition wall support 181 extending upward to support the partition wall 150 is disposed on a rear end of the third drain pan 180. The partition wall support 181 may be provided in a plate shape and coupled to an inner surface of the partition wall 150.

The third drain pan 180 is provided to seat and support the second drain pan 170, and the second drain pan 170 has a groove into which the partition wall support 181 is inserted so that the third drain pan 180 is firmly coupled.

The third drain pan 180 may be integrated with the first drain pan 160.

The front cover 190 defines a front surface of the passage partition module 100 and has an upper end connected to the casing support 120 and a lower end coupled to third drain pan 180. The front cover 190 defines the first heat exchange chambers 130*a*, 130*b*, and 130*c* together with the casing support 120, the first guide part 130, the partition wall 150, the second guide part 140, and the drain pans 160, 170, and 180.

Figure 16:
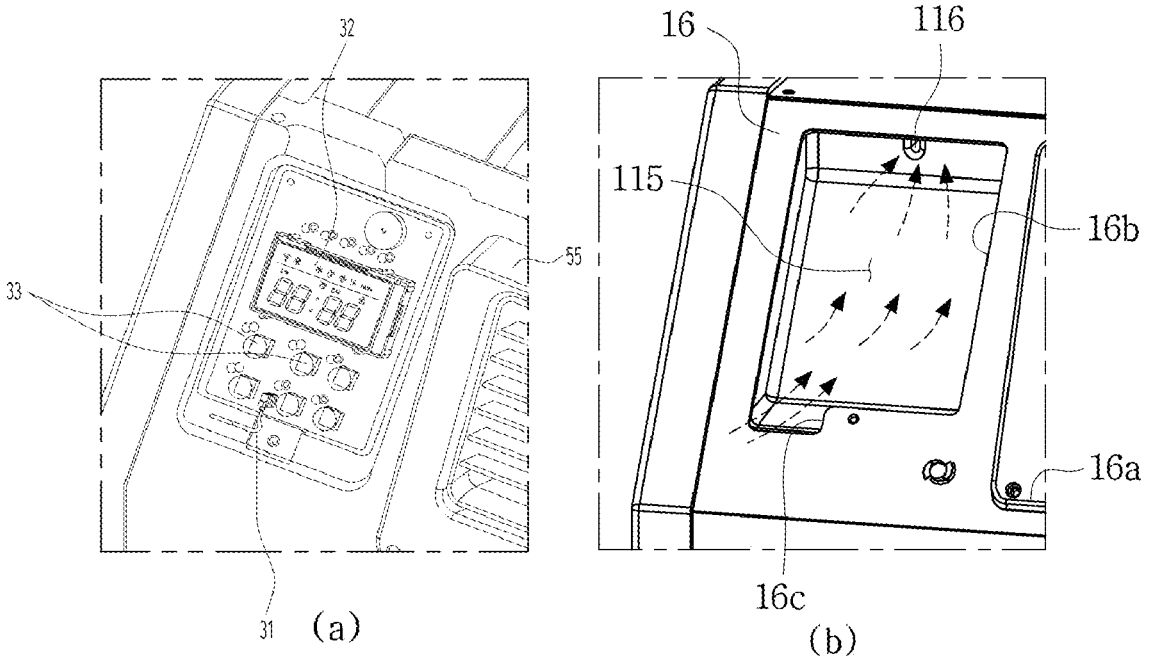
FIGS. 16 and 17 are views of a temperature sensor that measures a temperature of external air and an accommodation part that accommodates the temperature sensor.
Figure 17:
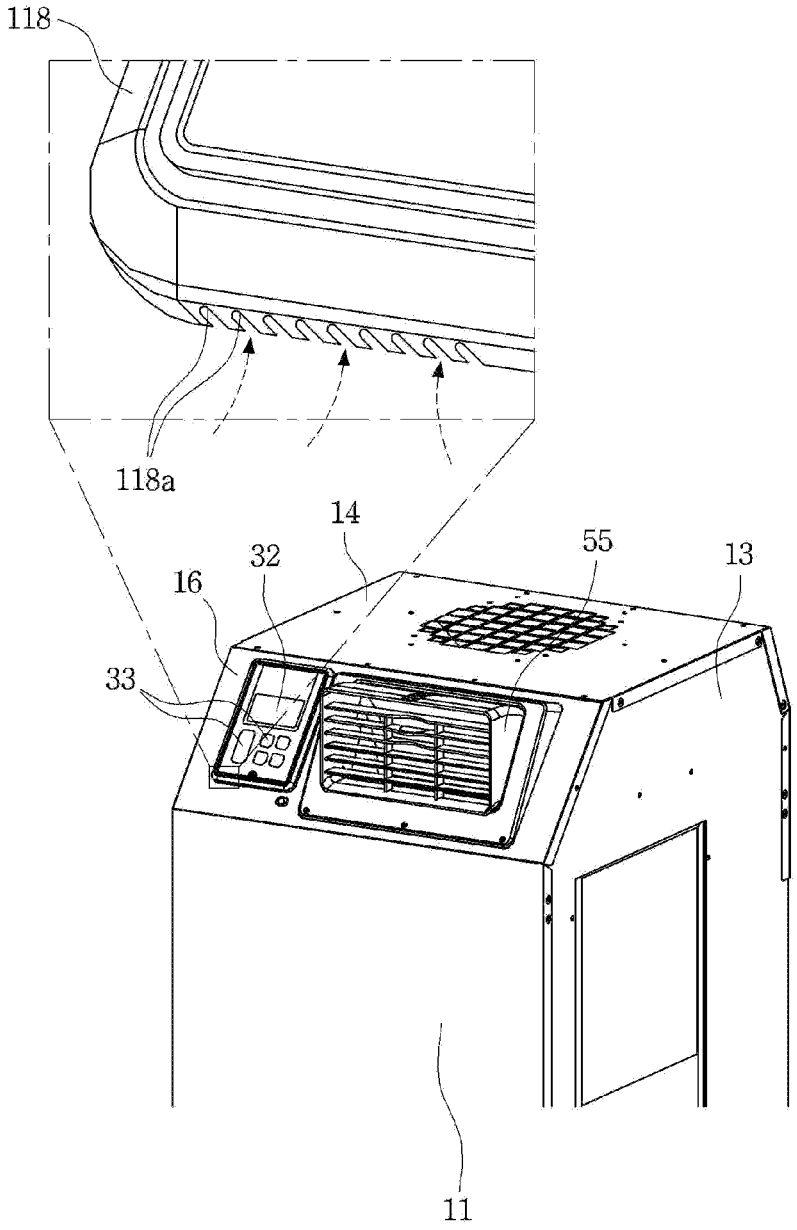

Hereinafter, a structure for measuring a temperature of the external air using a temperature sensor 31 will be described with reference to FIGS. 16 and 17. FIGS. 16 and 17 are views illustrating a temperature sensor 31 that measures a temperature of the external air and an accommodation part 115 that accommodates the temperature sensor 31.

Referring to FIGS. 16 and 17, the accommodation part 115 of the inner casing 110 accommodates electronic components that receive power to generate heat in addition to the temperature sensor 31.

The heat generation source includes a manipulation part 33 receiving a user command including a command for operating one or more of the heat exchangers 21 and 22 and the blower fan 50 and a display part accommodated in the accommodation part 115 to display predetermined information including the input user command.

Figure 11:
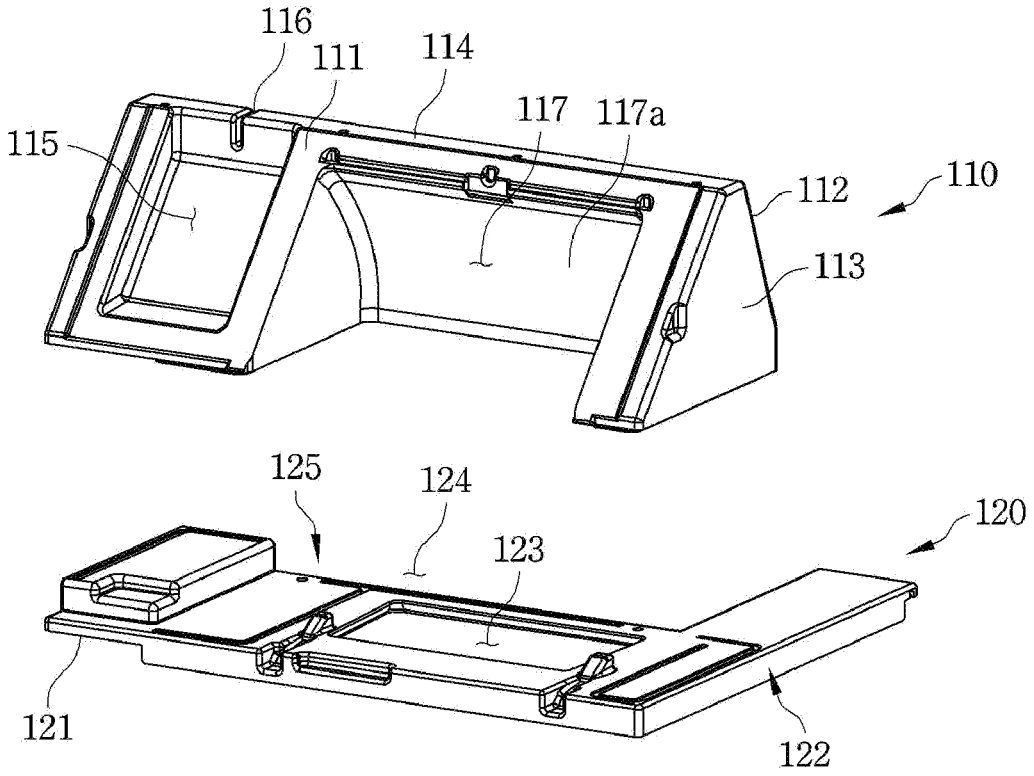

As illustrated in FIG. 11, the accommodation part 115 is disposed very close to the front discharge passage 117 for the design of a compact and highly efficient portable air conditioner 1, and thus is subject to thermal interference. That is, when the cold air or the hot air is discharged through the front discharge passage 117, a temperature of the adjacent accommodation part 115 may increase or decrease.

Particularly, when the temperature sensor 31 is disposed in the accommodation part 115, it is difficult to accurately measure the temperature of the external air. For this, the accommodation part 115 is provided so that external air is introduced into the accommodation part 115 to move to the heat exchange chamber through the communication groove 116.

In this case, the communication groove 116 may pass through an inner surface of the accommodation part 115 and the casing rear surface 112 and may be provided by recessing the casing top surface 114 as described above.

The casing front surface 111 is covered by the front inclined panel 16, and the front inclined panel 16 has a first through-hole 16*a* communicating with the front discharge passage 117 and second through-holes 16*b* and 16*c* communicating with the accommodation part 115. The casing top surface 114 is covered by the upper panel 14.

The first through-hole 16*a* and the second through-holes 16*b* and 16*c* are defined adjacent to each other, and the second through-hole 16*b* and 16*c* includes a main through-hole 16*b* and a sub through-hole 16*c* provided below the main through-hole 16*b* and having a surface area less than that of the main through-hole 16*b*.

The main through-hole 16*b* includes one area and the other area disposed at an opposite side of the one area and closer to the first through-hole 16*a* than the one area, and the sub through-hole 16*c* communicates with the one area.

The temperature sensor 31 is provided in a region of the accommodation part 115 corresponding to the sub through-hole 16*c*, and other heat generation sources such as the manipulation part 33 and the display part 32 are disposed in a region of the accommodation part corresponding to the main through-hole 16*b*. Thus, the temperature sensor 31 is disposed below other heat generation sources.

The second through-holes 16*b* and 16*c* may be provided with an accommodation part cover 118 that covers the second through-holes 16*b* and 16*c*, and thus, heat may be prevented from being directly received from an external heat generation source rather than the external air such as direct sunlight to more accurately measure the temperature of the external air. The accommodation part cover 118 is provided with a grill part 118*a* at a lower side, which allows the inside and the outside to communicate with each other. The grill part 118*a* is provided in a region corresponding to the sub through-hole 16*c*.

Thus, the temperature sensor 31 is provided below the heat generation source, the communication groove 116 is provided above the heat generation source, and the grill part 118*a* is provided below the temperature sensor 31.

When the blower fan 50 operates to generate the negative pressure in the heat exchange chamber, the external air sequentially passes through the grill part 118*a* and the second through-holes 16*b* and 16*c* to reach the temperature sensor 31. Thus, the temperature sensor 31 may accurately measure the temperature of the external air, and the external air reaching the temperature sensor 31 is introduced into the heat exchange chamber through the communication groove 116 via the heat generation source disposed at the top of the temperature sensor 31. This process has the added benefit of cooling the heat generation source.

Figure 18:
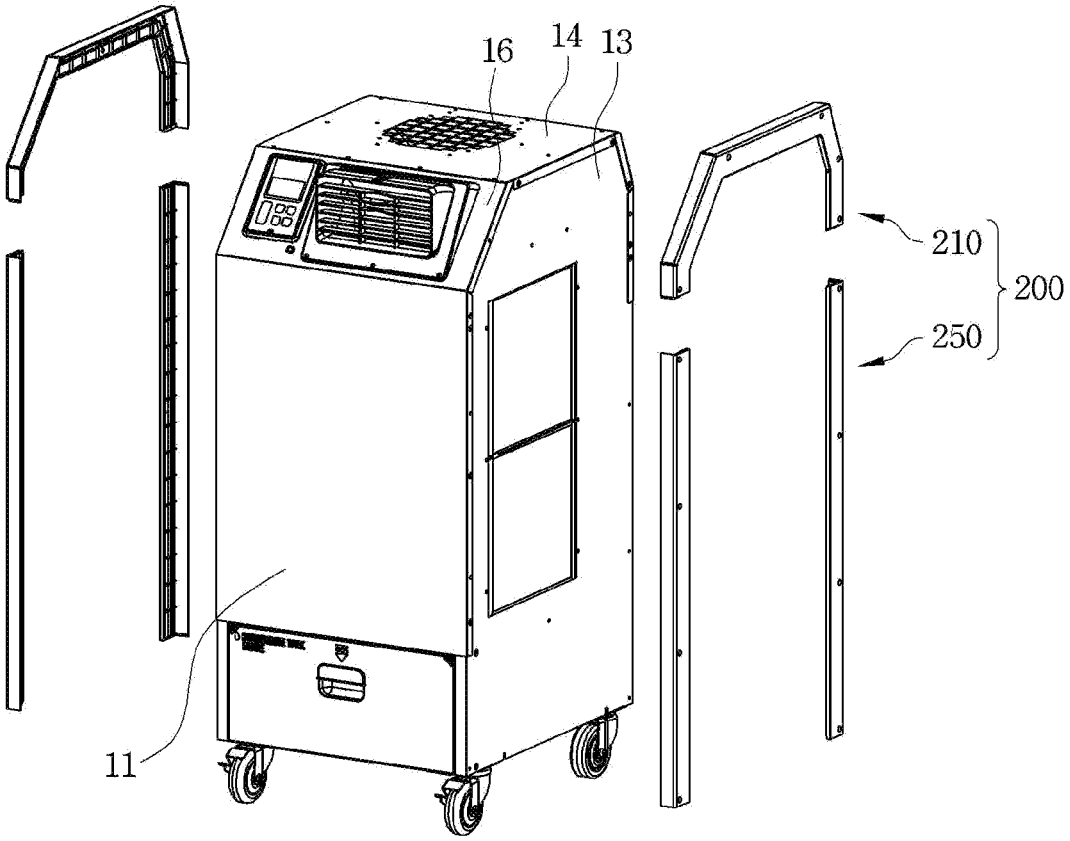
FIG. 18 is a view of a housing and a bumper provided in the housing.

Hereinafter, a bumper provided in the housing 10 will be described with reference to FIGS. 18 to 20. FIG. 18 is a view of the housing 10 and a bumper 200 provided in the housing 10, FIGS. 19 and 20 are view for explaining a coupling relationship between an upper bumper 210 and a lower bumper 250, which are illustrated in FIG. 18, and FIG. 20 is a view illustrating an angle defined inside the bumper.

Figure 19:
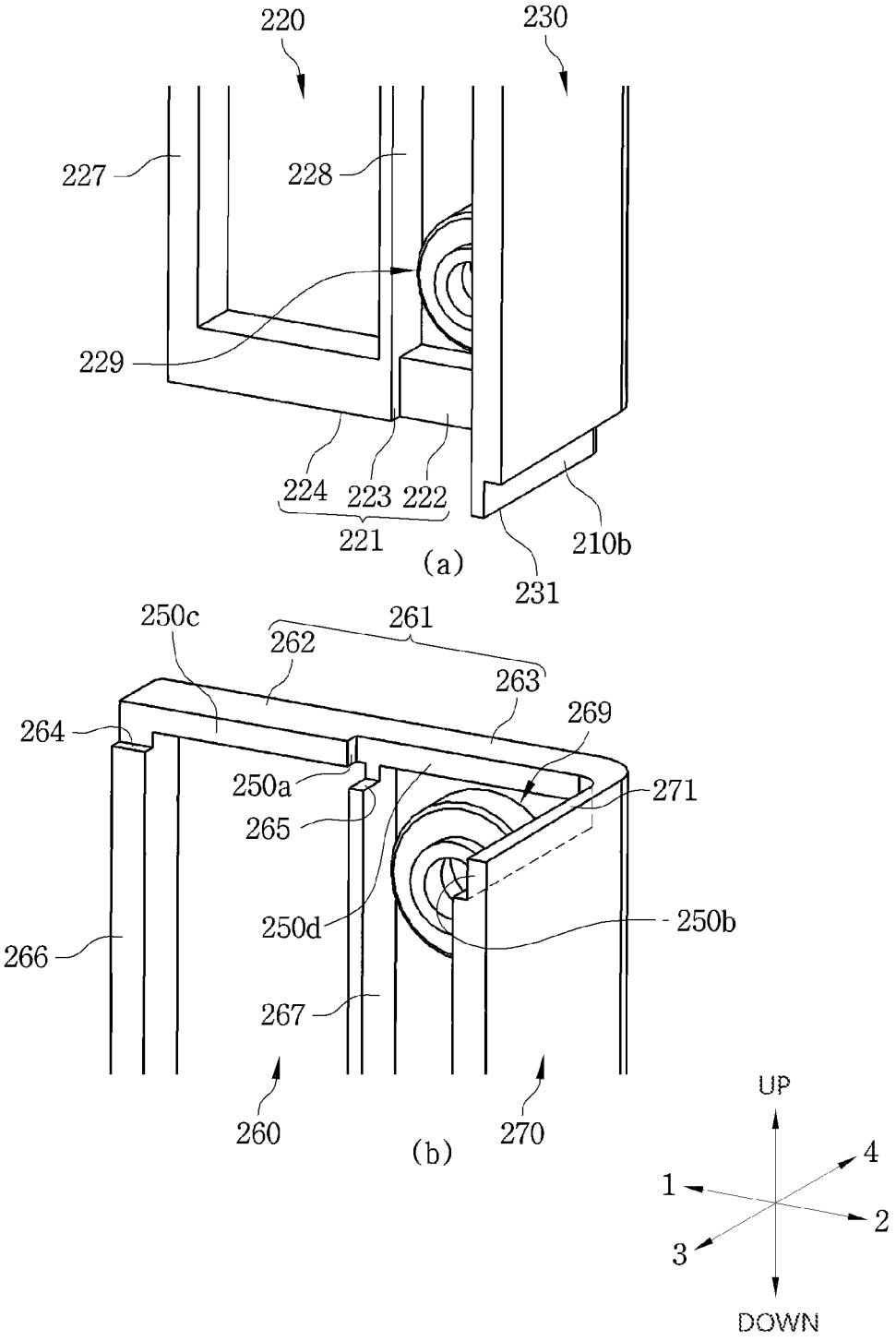
FIGS. 19 and 20 are view for explaining a coupling relationship between an upper bumper and a lower bumper, which are illustrated in FIG. 18.
Figure 20:
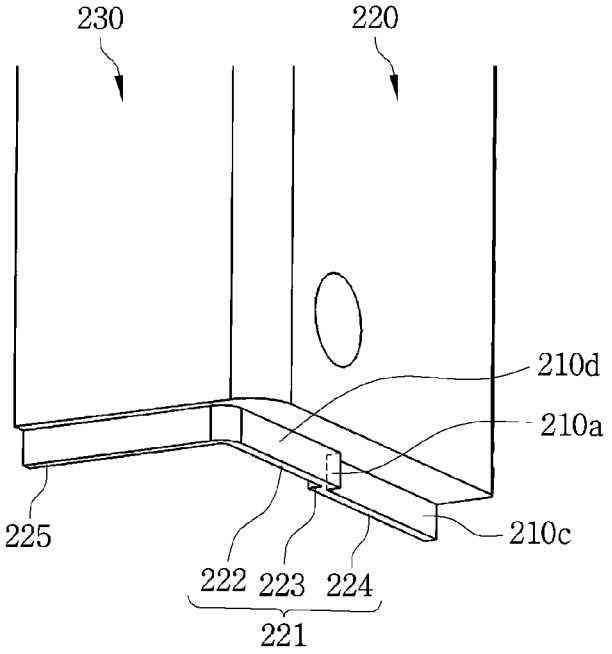
Figure 20:
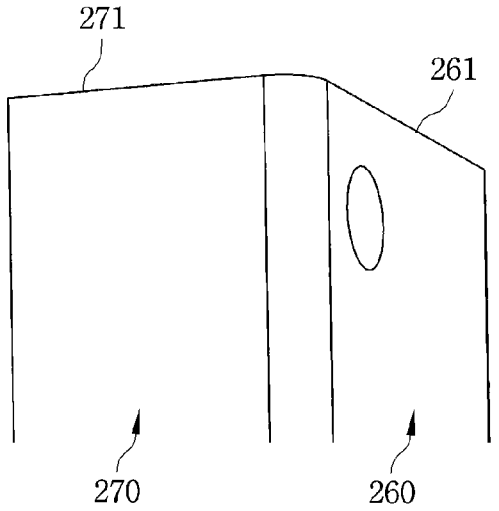
Figure 20:
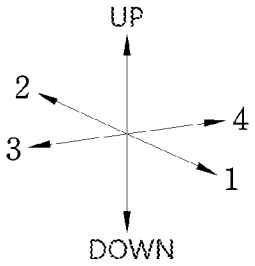
Figure 21:
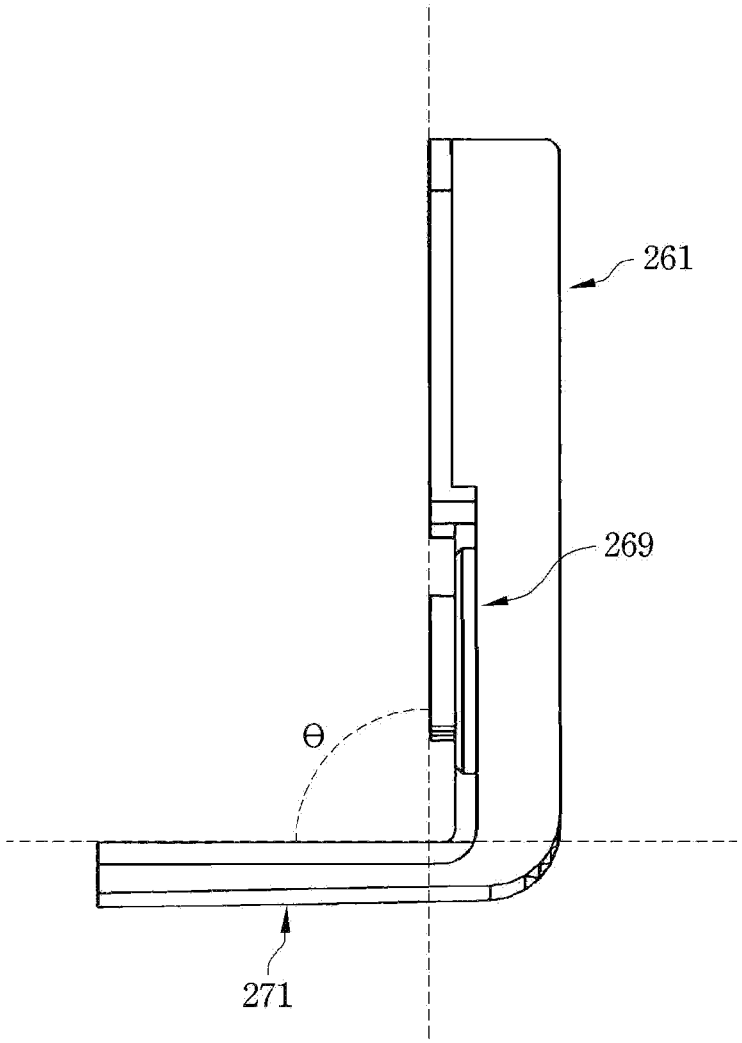
FIG. 21 is a view illustrating an angle defined inside the bumper.

Referring to FIGS. 18 to 20, the bumper 200 constitutes the housing 10 and is provided at an edge at which the first panel, i.e., a first outer surface, and second panel, i.e., a second outer surface, which adjacent to each other, meet each other to protect the portable air conditioner 1 from an external impact. For example, the first panel may be the front panel 11, and the second panel may be the first side panel 13.

The bumper 200 includes an upper bumper 210 and a lower bumper 250 coupled to a lower side of the upper bumper 210.

The upper bumper 210 includes a first upper body 220 provided to be fixed to the first panel and a second upper body 230 connected to the first upper body 220 and provided to be in contact with the second panel.

The lower bumper 250 includes a first lower body 260 fixed to the first panel and coupled to a lower end of the first upper body 220 and a second lower body 270 connected to the first lower body 260, coupled to a lower end of the second upper body 230, and in contact with the second panel.

The upper bumper 210 and the lower bumper 250 are provided to interfere with one or more sliding operations on the first panel or the second panel.

Specifically, the upper bumper 210 is provided with a first upper coupling rib 221 and a second upper coupling rib 231 connected to the first upper coupling rib 221 at a lower end thereof.

The first upper coupling rib 221 is provided to protrude downward from a lower end of the first upper body 220 and extends in a first direction (arrow 1) or a second direction (arrow 2), which is parallel to the outer surface of the first panel, in FIGS. 19 and 20.

The first upper coupling rib 221 includes an upper inner rib 224 of which an inner surface is in contact with the first panel, an upper outer rib 222 of which an inner surface is spaced apart from the first panel and connected to the second upper coupling rib 231, and an upper connection rib 223 that connects the upper inner rib 224 to the upper outer rib 222 and has a first upper interference surface 210*a* at one side to face the first direction (arrow 1).

The outer surface of the upper inner rib 224 facing a fourth direction (arrow 4) defines a third upper interference surface 210*c*. The third upper interference surface 210*c* is disposed in a direction opposite to the inner surface.

The outer surface of the upper outer rib 222 facing the fourth direction (arrow 4) defines a fourth upper interference surface 210*d*. The fourth upper interference surface 210*d* is disposed in a direction opposite to the inner surface. The upper outer rib 222 is connected to the second upper coupling rib 231.

The second upper coupling rib 231 is provided to protrude downward from a lower end of the second upper body 230 and extends in a third direction (arrow 3) or a fourth direction (arrow 4), which is parallel to the outer surface of the second panel, in FIGS. 19 and 20.

The second upper coupling rib 231 extends downward from the inside of a lower end of the second upper body 230, and the outer surface facing the second direction (arrow 2) defines the second upper interference surface 210*b*.

The lower bumper 250 is provided with a first lower coupling rib 261 coupled to the first upper coupling rib 221 and a second lower coupling rib 271 connected to the first lower coupling rib 261 and coupled to the second upper coupling rib 231.

The first lower coupling rib 261 is provided to protrude upward from an upper end of the first lower body 260 and extends in the first direction (arrow 1) or the second direction (arrow 2). The first lower coupling rib 261 includes a lower inner rib 262 on which a third lower interference surface 250*c* that faces and is in contact with the third upper interference surface 210*c* is disposed, and a lower outer rib 263 which extends upward from an upper end of the first lower body 260 and on which a fourth lower interference surface 250*d* that faces and is in contact with the fourth upper interference surface 210*d* is disposed.

The lower inner rib 262 includes an outer surface facing the fourth direction (arrow 4) and an inner surface facing the third direction (arrow 3), and the inner surface defines the third lower interference surface 250*c*.

Similarly, the lower outer rib 263 includes an outer surface facing the fourth direction (arrow 4) and an inner surface facing the third direction (arrow 3). Among these, the inner surface defines the fourth lower interference surface 250*d*.

The lower inner rib 262 has a width greater than that of the lower outer rib 263 and is provided with a first lower interference surface 250*a* facing the second direction (arrow 2) on the surface connected to the inner surface of the lower outer rib 263.

The second lower coupling rib 271 is provided to protrude upward from an upper end of the second lower body 270 and extends in the third direction (arrow 3) or the fourth direction (arrow 4). The second lower coupling rib 271 is provided with an inner surface facing the first direction (arrow 1) and an outer surface facing the second direction (arrow 2), and the inner surface defines a second lower interference surface 250*b* that faces and is in contact with the second upper interference surface 210*b*.

The first upper body 220 is provided with an upper fixing part 229 through which a fixing member for fixing the first upper body 220 to the first panel is supported to pass. The upper fixing part 229 is closer to the upper outer rib 222 than the upper inner rib 224 and is provided above the upper outer rib 222.

The first upper body 220 is provided with a first upper reinforcing rib 227 and a second upper reinforcing rib 228, which extends in a vertical direction and is connected to the upper inner rib 224.

The first lower body 260 is provided with a lower fixing part 269 through which a fixing member for fixing the first lower body 260 to the first panel is supported to pass, and the lower fixing part 269 is closer to the lower outer rib 263 than the lower inner rib 262 and is provided below the lower outer rib 263.

The first lower body 260 is provided with a first lower reinforcing rib 266 and a second lower reinforcing rib 267 extending in the vertical direction. The first lower reinforcing rib 266 is connected to the lower inner rib 262, and an upper end of the first lower reinforcing rib 266 defines a first seating surface 264. The first seating surface 264 has a height less than that of a top surface of the lower inner rib 262 to generate a stepped portion and is configured to seat the upper inner rib 224.

The second lower reinforcing rib 267 is connected to the lower outer rib, and an upper end of the first lower reinforcing rib 266 defines a first seating surface 265. The second seating surface 265 has a height less than that of a top surface of the lower outer rib 263 to generate a stepped portion and is configured to seat the upper outer rib 222.

The second lower body 270 has a height less than that of the top surface of the second lower coupling rib 271 to generate a stepped portion and is provided with a third seating surface 268 on which the second upper coupling rib 231 is seated. The third seating surface 268 faces upward, defines a stepped portion with the top surface of the second lower coupling rib 271, and is connected to the inner surface of the second lower coupling rib 271.

The inner surfaces of the first lower body 260 and the second lower body 270 are angled at a predetermined angle with respect to each other, and the predetermined angle is less than about 90 degrees. Therefore, it is in easily contact with the first panel and the second panel when installed. This structure is the same for the first upper body 220 and the second upper body 230.

Under this structure, when external force is applied to the upper bumper 210 in the first direction (arrow 1), the first lower interference surface 250*a* interferes with the first upper interference surface 210*a*, and thus, shear force applied to the upper fixing part 229 is minimized.

When external force is applied to the upper bumper 210 in the second direction (arrow 2), the second lower interference surface 250*b* interferes with the second upper interference surface 210*b*, and thus, shear force applied to the upper fixing part 229 is minimized.

When external force is applied to the upper bumper 210 in the third direction (arrow 3), the third lower interference surface 250*c* and the fourth lower interference surface 250*d* interfere with the third upper interference surface 210*c* and the fourth upper interference surface 210*d*, and thus, force applied to the upper fixing part 229 in the longitudinal direction of the fixing member such as a bolt is minimized.

Figure 22:
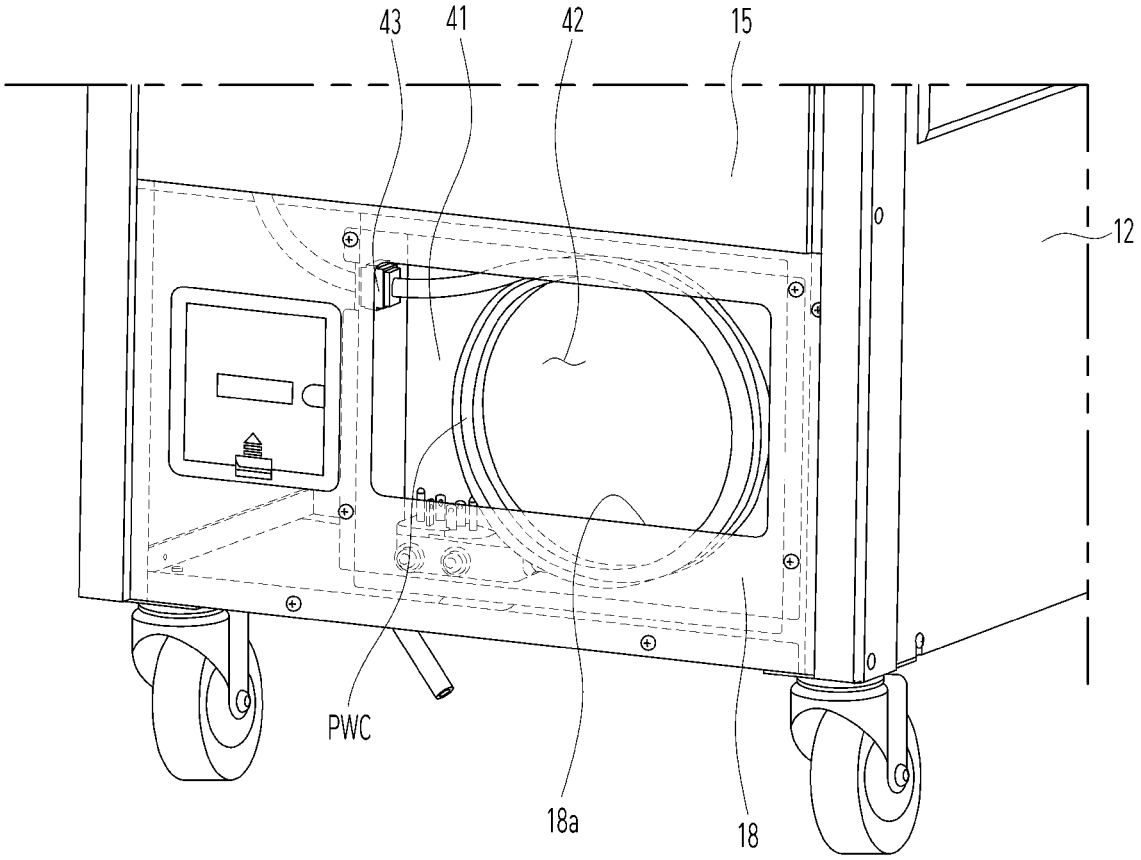
FIG. 22 is a view illustrating a structure that accommodates a power cord.

Hereinafter, a structure for accommodating power cord (PWC) will be described with reference to FIG. 22. FIG. 22 is a view illustrating a structure that accommodates the power cord.

Referring to FIG. 22, the structure for accommodating the power cord (PWC) has a predetermined opening defined in the rear panel 15, and a plate-shaped cord cover part 18 covers the opening.

The cord cover 18 is provided with an opening that serves as an entrance for the power cord (PWC), and the opening of the cord cover 18 is less than the opening of the rear panel 15.

An inner bent plate 41 having a predetermined space is coupled to an inner surface of the cord cover 18. The inner bent plate 41 is provided in a shape of a plate with one side recessed and has a side surface that defines an inner surface having a predetermined space. A predetermined space defines a power cord accommodation part 42 that accommodates the power cord (PWC).

A power cord fixing part 43 is provided on the side surface of the inner bent plate 41 so that the power cord (PWC) is penetrated to be supported.

Figure 23:
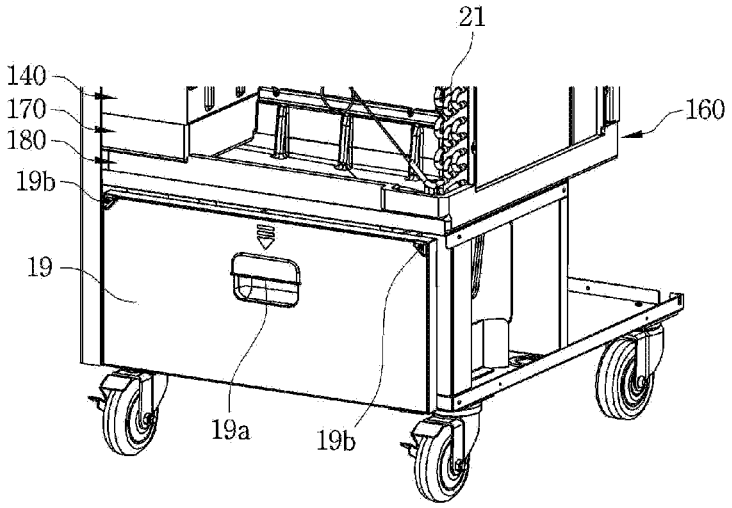
FIG. 23 is a view illustrating a draw-out structure of a water tank and a structure that measures a water level.
Figure 23:
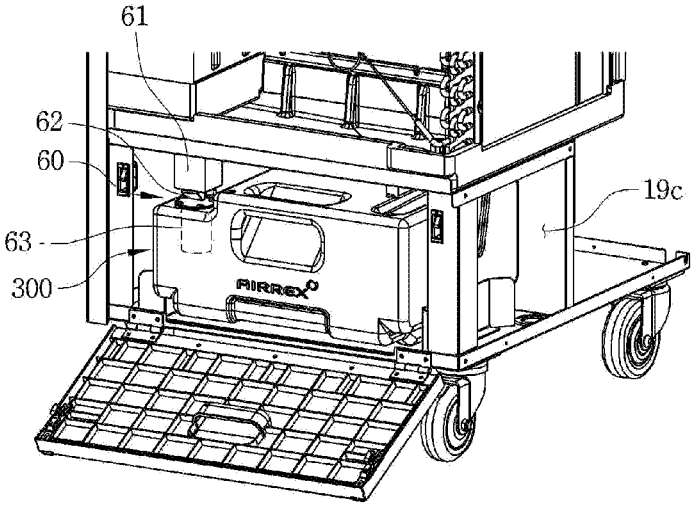
Figure 24:
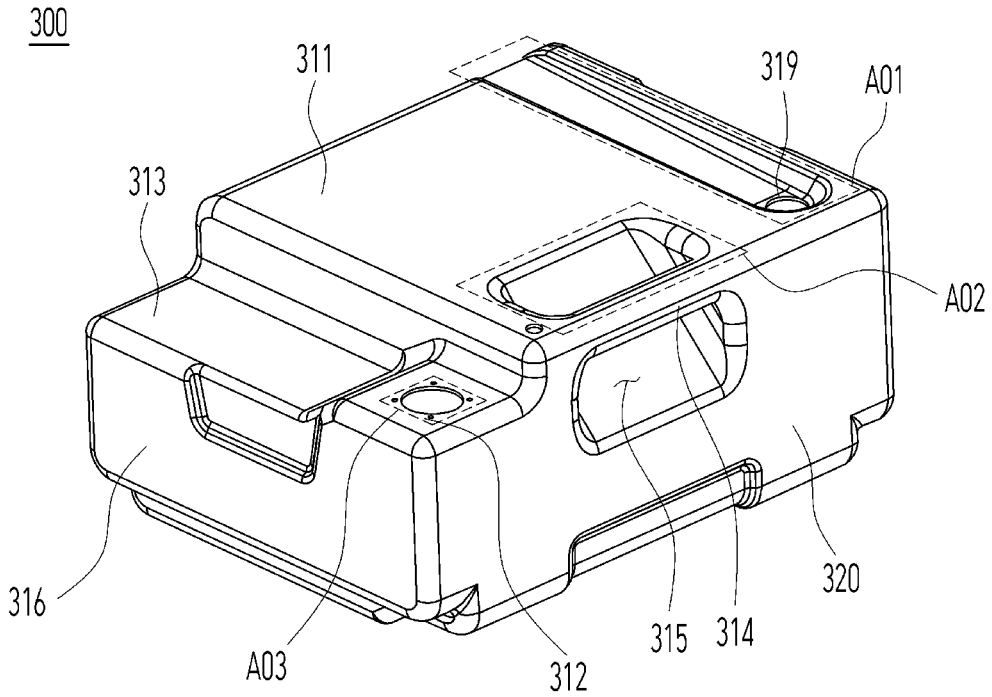
FIGS. 24 and 25 are perspective views of the water tank illustrated in FIG. 23.
Figure 25:
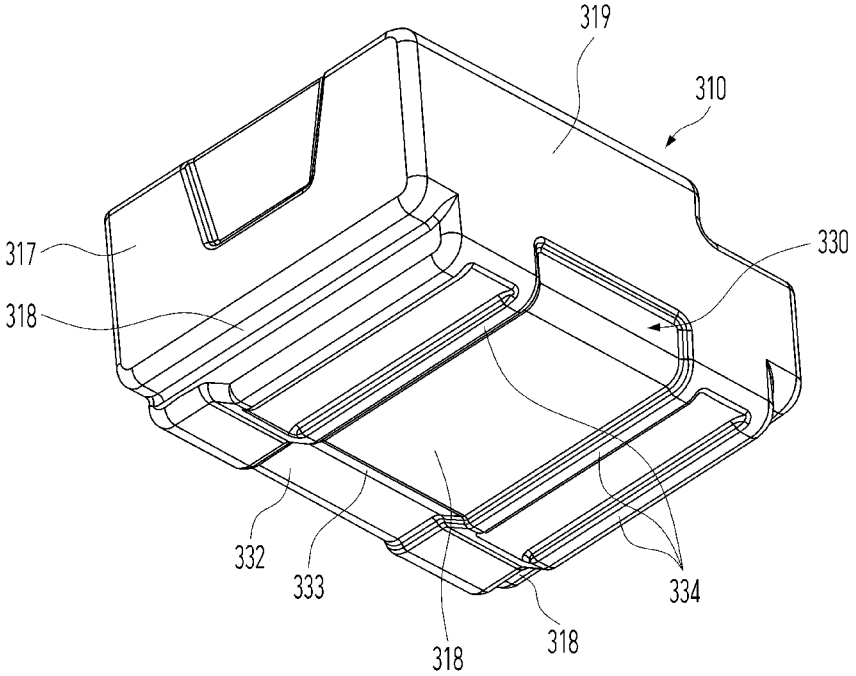
Figure 26:
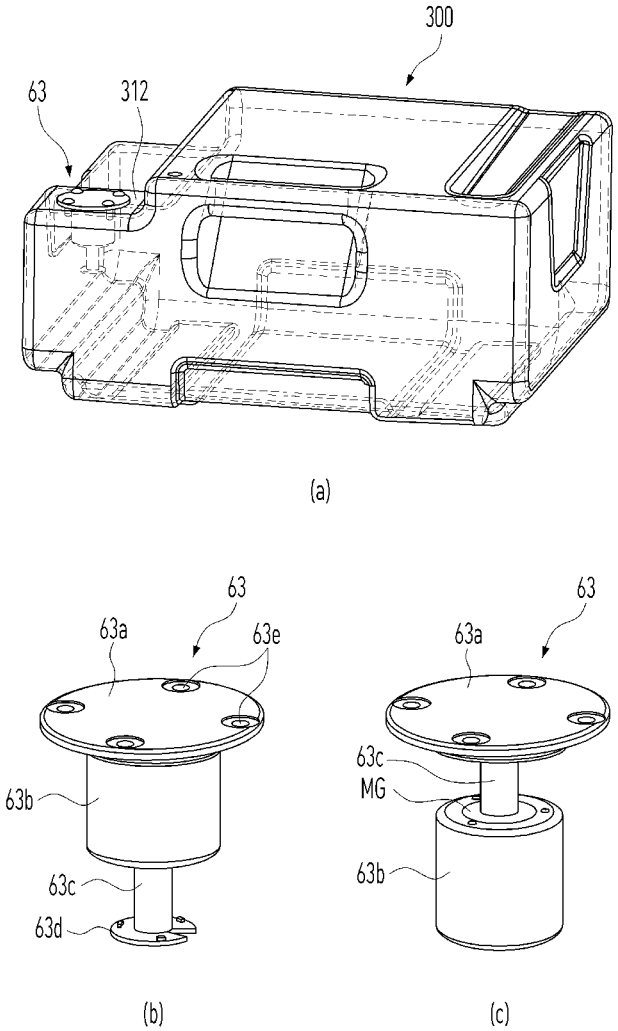
FIG. 26 is a view illustrating the structure that measures the water level illustrated in FIG. 23.

Hereinafter, a draw-out structure of the water tank 300 and a structure for measuring the water level will be described with reference to FIGS. 23 to 26. FIG. 23 is a view illustrating a draw-out structure of the water tank 300 and a structure that measures a water level, FIGS. 24 and 25 are perspective views of the water tank 300 illustrated in FIG. 23, and FIG. 26 is a view illustrating the structure that measures the water level illustrated in FIG. 23.

Referring to FIGS. 23 to 26, a revolving door 19 that rotates in a vertical direction is provided in front of the machine room 19*c* of the housing 10, and the machine room 19*c* is opened and closed by the revolving door 19.

The revolving door 19 is provided with a handle 19*a*, and a lower end thereof is hinged to the housing 10. When rotating downward to open the machine room 19*c*, a pair of impact prevention pads 19*b* are provided on an outer surface of an upper end to cushion collision with the external floor.

The water tank 300 is provided to be withdrawn from the machine room 19*c* and provides a space in which condensate collected by the drain pans 160, 170, and 180 falls and is stored. A water level of condensate stored in the water tank 300 is sensed by a water level detection part 60.

The water level detection part 60 includes a support frame 61 extending downward from a ceiling of the machine room 19*c*, a proximate sensor 62 supported by the support frame 61, and a floating part 63 that is floated in the condensate collected in the water tank 300 and includes a predetermined magnet (MG) to be sensed by the proximate sensor 62.

As illustrated in FIG. 26, the floating part 63 includes a coupling plate 63*a* with a coupling hole 63*e* to be coupled to a second top surface 312 of the water tank 300, which will be described later, a guide tube 63*c* extending downward from a lower end of the coupling plate 63*a*, a floating body 63*b* that has buoyancy to move in the vertical direction along the guide tube 63*c* according to the water level of the condensate and is provided with a magnet (MG) on a top surface thereof, and a stopper 63*d* provided at a lower end of the guide tube 63*c* to prevent the floating body 63*b* from be separated from the guide tube 63*c*.

The support frame 61 extends downward so that the lower end thereof is very close to the second top surface 312 of the water tank 300 introduced into the machine room 19*c*. Thus, when the water tank 300 is fully filled by the condensate, the proximate sensor 62 and the floating body 63*b* are close to each other so that the proximate sensor 62 sufficiently detects the magnet of the floating body.

The water tank 300 has a top surface, a bottom surface, a front surface 320 connecting front ends of the top and bottom surfaces to each other, a rear surface 319 connecting rear ends of the top and bottom surfaces to each other, and a first side surface 316 and a second side surface 317, which connect the top surface to the bottom surface and the front surface 320 to the rear surface 319.

The top surface includes a first top surface 311 having a condensate inflow area A01, a second top surface 312 provided with a water level detection area A03 and adjacent to the first top surface 311 to support one side of the floating part 63, and a third top surface 313 extending backward from the second top surface 312.

The condensate inflow area A01 is provided at a front end of the water tank 300 and is an area into which the condensate is introduced. The condensate inflow area A01 is provided at a front end of the first top surface 311.

The water level detection area A03 is provided at the front end of the water tank 300 and is an area on which the water level is detected. The water level detection area A03 is provided at a front end of the second top surface 312 and has a height less than the height of the condensate inflow area A01 to prevent the water level of the water tank 300 from rising up to the condensate inflow area A01. Thus, when the water tank 300 is drawn out and erected, the condensate of the water tank 300 is prevented from flowing out through the condensate water inflow area A01 or a water tank inlet 311*b*, which will be described later.

The water tank 300 is provided at the front end of the first top surface 311 and further includes a handle area A02 on which the handle 314 is disposed.

The handle area A02 may have a height greater than that of the condensate inflow area A01 to prevent the condensate collected in the water tank 300 from flowing back through the condensate inlet area A01 and being discharged to the outside when the water tank 300 is drawn out and erected.

The handle is disposed at an edge at which the first top surface 311 and the front surface 320 of the water tank 300 are coupled to each other. In addition, to improve user convenience, a grip hole 315 which defines a space surrounding the handle 314 and in which one side of the first top surface 311 and one side of the front 320 of the water tank 300 are recessed to communicate with each other may be provided.

In addition, the water tank 300 is provided with a water tank inlet 311*b* provided to pass through the front end of the first top surface 311 and a water tank guide groove extending long in the front and rear direction on the first top surface 311 and having the bottom that is inclined downward toward the front side to guide the condensate to the water tank inlet 311*b*.

The water tank 300 includes an upper water tank 300 and a lower water tank 300 disposed at a lower end of the upper water tank 300.

The upper water tank 300 is provided with the first top surface 311, the second top surface 312, and the third top surface 313, which are described above, and the lower water tank 300 communicates with the upper water tank 300, has a cross-sectional area less than that of the upper water tank 300, and is in contact with the bottom surface of the machine room 19*c*.

The lower water tank 300 has a width less than that of the upper water tank 300 and a length equal to or the same as the length of the upper water tank 300.

The lower water tank 300 has a first water tank bottom surface 331 that is in contact with the bottom surface of the machine room 19*c*, a second water tank bottom surface 332 that is provided behind the first water tank bottom surface 331 and is higher than the first water tank bottom surface 331, and an inclined bottom surface 333 connecting the first water tank bottom surface 331 to the second water tank bottom surface 332.

The first water tank bottom surface 331 is wider than the second water tank bottom surface 332, and is provided with a plurality of downward convex portions 334 that protrude convexly and extend from the front end to the rear end. This is to prevent dew condensation from being formed on an area that is in contact with the water tank 300 due to a low temperature of the stored condensate by reducing the contact area.

A hook protrusion (not shown) is provided in front of the machine room 19*c* to prevent the water tank 300 from being separated, and a bottom surface of the downward convex portion 334 has one side that is curved to define one surface with the front surface 320 of the water tank 300.

The upper water tank 300 is provided with a pair of side surfaces 316 and 317 and a pair of third water tank bottom surfaces 318 connected to the pair of side surfaces 316 and 317 and provided at a position higher than the bottom surface 332 of the second water tank bottom surface 332 to extend from the front surface 320 to the rear surface 319 of the upper water tank 300.

When the water tank 300 is drawn out from the machine room 19*c*, a top surface of a rear end of the water tank 300 may interfere by the support frame 61 extending downward to prevent the water tank 300 from being drawn out. To prevent this, the third top surface 313 has a height lower than the second top surface 312 to avoid the interference with the support frame 61 when the water tank 300 is drawn out.

Figure 27:
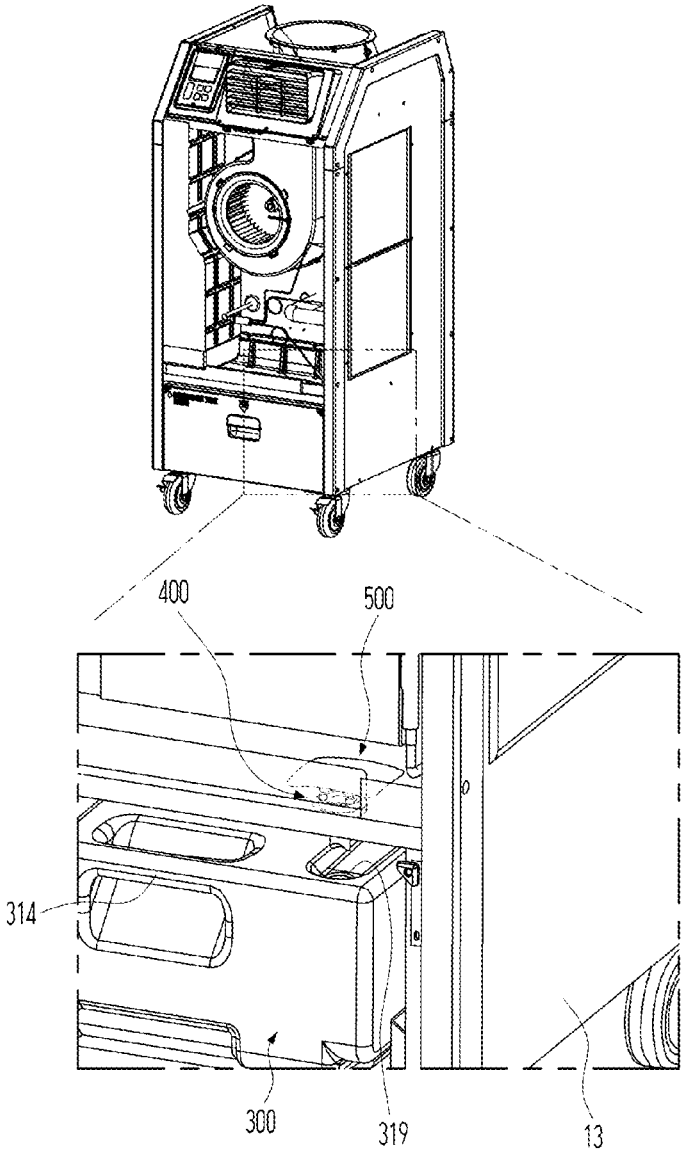
FIG. 27 is a view illustrating a structure that guides condensate to the water tank without being scattered.

Hereinafter, a structure that guides the condensate to the water tank 300 without being scattered will be described with reference to FIGS. 27 to 29. FIG. 27 is a view illustrating a structure that guides the condensate to the water tank 300 without being scattered, and FIGS. 28 and 29 are views illustrating a scattering prevention part 500 and a drain guide part 400, which are illustrated in FIG. 27.

Figure 28:
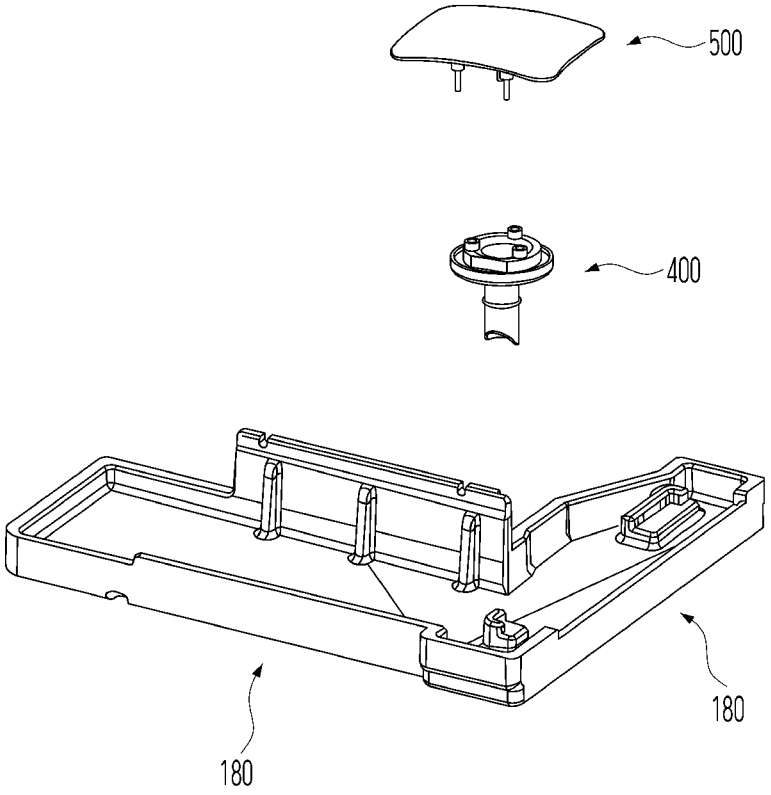
FIGS. 28 and 29 are views illustrating a scattering prevention part and a drain guide part, which are illustrated in FIG. 27.
Figure 29:
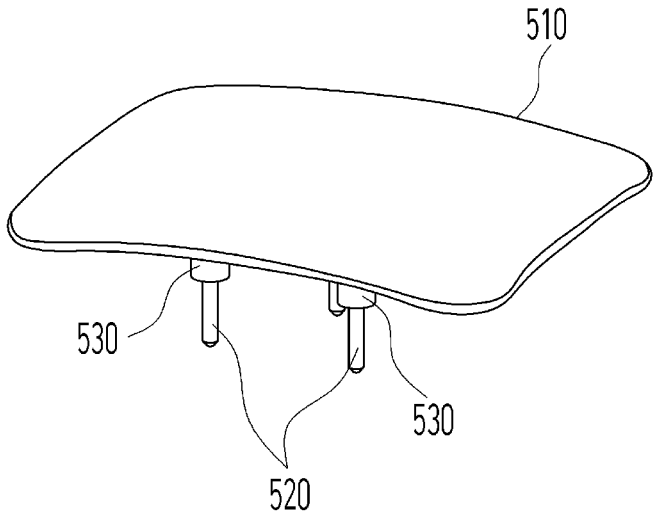
Figure 29:
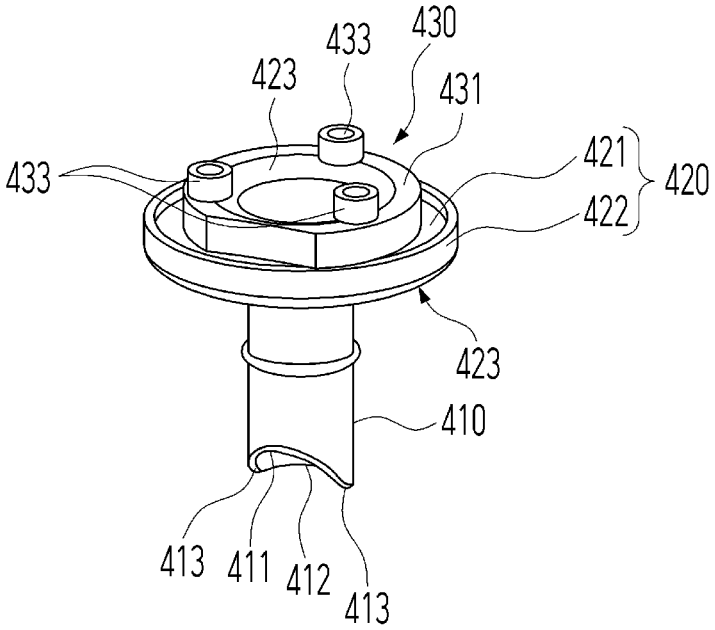

Referring to FIGS. 27 to 29, when the first heat exchanger 21 functions as the evaporator, the condensate generated in the first heat exchanger 21 is collected in the first drain pan 160 and then falls into the water tank 300 through a condensate discharge port 184 of the third drain pan 180 and is stored. In addition, when the refrigerant of the heat pump is circulated in the reverse direction, and the second heat exchanger 22 functions as the evaporator, the condensate generated in the second heat exchanger 22 is collected in the second drain pan 170 to fall into the third drain pan 180 and move and then falls into and is stored in the water tank 300 through the condensate discharge port 184.

The first heat exchange chambers 130*a*, 130*b*, and 130*c* are disposed above the third drain pan 180, and the machine room 19*c* in which the water tank 300 is disposed is disposed below the third drain pan 180. When the negative pressure is generated in the first heat exchange chambers 130*a*, 130*b*, and 130*c* by the first fan 52, the external air is introduced from the first inlet 13*a*, and simultaneously, air is introduced into the machine room 19*c* in which the water tank 300 is disposed through the condensate discharge port 184.

In this case, when the magnitude of the negative pressure is above a certain level, a flow of the air introduced from the machine room 19*c* through the condensate discharge port 184 is gradually accelerated to cause a phenomenon in which the condensate falling from the condensate discharge port 184 and the condensate disposed near the condensate discharge port 184 are scattered and sprayed into the first heat exchange chambers 130*a*, 130*b*, and 130*c*. Furthermore, the scattered condensate may also be sprayed into the second heat exchange chambers 140*a*, 104*b*, and 104*c*.

To prevent this phenomenon, the condensate discharge port 184 is provided with a drain guide part 400 and a scattering prevention part 500.

The drain guide part 400 includes a drain pipe 410 and a flange part 420.

The drain pipe 410 extends in the vertical direction and is provided with a passage therein to guide the condensate collected in the third drain pan 180 downward.

The drain pipe 410 has a first inclined cutoff part 411, a second inclined cutoff part 412, and a pair of peaks 413 so that the condensate moving downward along the passage quickly clump up and fall.

The first inclined cutoff part 411 is defined by cutting one side of a lower end of the drain pipe 410 in an upwardly convex shape. Thus, both ends of the first inclined cutoff part 411 are disposed lower than a central portion. As an example, the first inclined cutoff part 411 may be provided by cutting one side of the lower end of the drain pipe 410 in an upwardly inclined direction outward from a lower center of the drain pipe 410 using a cutting blade. In this case, a cross-section of the lower end of the drain pipe 410, which is defined by the cutting through the cutting blade, may be disposed on a single flat plane.

The second inclined cutoff part 412 is defined by cutting the other side disposed opposite to the one side of the lower end of the drain pipe 410 in an upwardly convex shape. The second inclined cutoff part 412 is symmetrical with the first inclined cutoff part 411 with respect to a center of a lower end of the drain pipe 410.

The peak part 413 is formed sharply downward, and both ends of the first inclined cutoff part 411 and the second inclined cutoff part 412 meet to form a pair. A sharpness or angle of the peak part 413 may be adjusted depending on a cutting inclination direction.

The condensate moving downward along the drain pipe 410 moves to both ends of the first inclined cutoff part 411 or the second inclined cutoff part 412 along the first inclined cutoff part 411 or the second inclined cutoff part 412 and then collected at the peak part 413. Thus, a relatively large stream of water may be generated and prevented from being scattered. As the inclination angle of the first inclined cutoff part 411 or the second inclined cutoff part 412 increases, the condensate is more quickly collected in the peak part 413.

The flange part 420 is provided on an upper end of the drain pipe 410 and is coupled to the bottom of the third drain pan 180 so that the drain pipe 410 communicates with the condensate discharge port 184 of the third drain pan 180.

The flange part 420 includes a first flange 421 that extends radially outward from an outer circumferential surface of the drain pipe 410, and a second flange 422 that extends radially outward from an outer circumferential surface of the first flange 421 and has a thickness greater than that of the first flange 421. A coupling stepped part 423 is provided on an outer circumference of a lower portion of the second flange 422 so as to be easily coupled by being seated on an inner surface of the condensate discharge port 184.

The drain guide part 400 is provided to protrude upward from an upper portion of the first flange 421 and further includes a reinforcing rib 430 having a hollow communicating with the drain pipe 410.

The reinforcing rib 430 is provided with a top surface 431 facing an upper side and a curved inner side surface 432 disposed around the hollow and having an inner circumferential surface defined by an inner circumferential surface being curved so that a cross-sectional area of the hollow gradually decreases as it goes downward. The top surface 431 and the curved inner side 432 may define one surface to minimize resistance applied to the condensate.

The drain guide part 400 is provided to protrude upward from an upper end of the reinforcing rib 430 and further includes one or more support bar insertion parts 433 in which a cover support bar, which will be described later, is inserted to be supported. The support bar insertion parts 433 are spaced a predetermined distance from each other along a ring-shaped reinforcing ribs 430 and thus is provided in plurality.

The scattering prevention part 500 includes a drain cover 510 having a predetermined area and the cover support bar 520 that is coupled to the flange part 420 to support a self-weight of the drain cover 510.

The drain cover 510 has a top surface curved convexly upward, and a bottom surface thereof is provided concavely upward to correspond to the top surface.

The cover support bar 520 is firmly supported by the support bar reinforcing part 530 disposed on the bottom surface of the drain cover 510 and is provided in plurality to correspond to the support bar insertion parts 433.

As described above, the embodiments of the present disclosure have the following effects.

First, according to the embodiments of the present disclosure, the cooling and the heating may be performed at the same time, and the effect of high space efficiency may be provided.

Second, according to the embodiments of the present disclosure, the thermal interference may be avoided to accurately measure the temperature of the external air.

Third, according to the embodiments of the present disclosure, the outer appearance may be protected from the collision during the movement.

Fourth, according to the embodiments of the present disclosure, the user convenience may be improved, and the water level may be accurately measured through the predetermined draw-out type water tank.

Fifth, according to the embodiments of the present disclosure, the condensate may be discharged from the inside without being scattered.

As described above, while the embodiments of the present disclosure have been described with reference to the specific embodiments, it will be apparent to those skilled in the art that various changes and modifications may be made without departing from the spirit and scope of the invention as defined in the following claims.

What is claimed is:

1. A bumper for a portable air conditioner, the bumper comprising:

a first outer surface and a second outer surface connected to the first outer surface;

an upper bumper and a lower bumper coupled to a lower side of the upper bumper, wherein the upper bumper comprises:

a first upper body fixed to the first outer surface; and a second upper body connected to the first upper body and in contact with the second outer surface, wherein the lower bumper comprises:

a first lower body fixed to the first outer surface and coupled to a lower end of the first upper body; and a second lower body connected to the first lower body, coupled to a lower end of the second upper body, and in contact with the second outer surface, wherein the upper bumper further comprises:

a first upper coupling rib provided on a lower end of the first upper body; and a second upper coupling rib provided on a lower end of the second upper body;

wherein the lower bumper further comprises:

a first lower coupling rib provided on an upper end of the first lower body and coupled to the first upper coupling rib; and a second lower coupling rib provided on an upper end of the second lower body and coupled to the second upper coupling rib;

wherein the first upper coupling rib includes a first upper interference surface facing a first direction away from the second outer surface, and the first lower coupling rib includes a first lower interference surface contacting the first upper interference surface; and wherein the second upper coupling rib includes a second upper interference surface facing a second direction opposite to the first direction, and the second lower coupling rib includes a second lower interference surface contacting the second upper interference surface, such that the first and second coupling ribs cooperatively engage to prevent relative sliding movement between the upper bumper and the lower bumper along the first outer surface and the second outer surface.

2. The bumper of claim 1, wherein the first upper coupling rib is provided with an outer interference surface parallel to the second outer surface and facing a third direction that faces the first outer surface, and the first lower coupling rib is provided with an inner interference surface facing a fourth direction that is a direction opposite to the third direction.

3. The bumper of claim 1, wherein the first upper coupling rib comprises:

an upper inner rib of which an inner surface is in contact with the first outer surface;

an upper outer rib of which an inner surface is spaced apart from the first outer surface and which is connected to the second upper coupling rib; and an upper connection rib configured to connect the upper inner rib to the upper outer rib and having one side at which the first upper interference surface is defined.

4. The bumper of claim 3, wherein the first upper body is provided with an upper fixing part through which a fixing member configured to fix the first upper body to the first outer surface passes and is supported, wherein the upper fixing part is closer to the upper outer rib than the upper inner rib and provided above the upper outer rib.

5. The bumper of claim 3, wherein the first lower coupling rib comprises:

a lower inner rib that is in contact with an outer surface disposed at a side opposite to an inner surface of the upper inner rib; and a lower outer rib that is in contact with an outer surface disposed at a side opposite to an inner surface of the upper outer rib, wherein the lower inner rib has a width greater than that of the lower outer rib and is provided with the first lower interference surface on a surface connected to the inner surface of the lower outer rib.

6. The bumper of claim 5, wherein the first lower body is provided with a lower fixing part through which a fixing member configured to fix the first lower body to the first outer surface passes and is supported, wherein the lower fixing part is closer to the lower outer rib than the lower inner rib and provided below the lower outer rib.

7. The bumper of claim 3, wherein the second upper coupling rib is connected to the upper outer rib.

8. The bumper of claim 5, wherein the first lower body comprises:

a first seating surface which has a height lower than that of an upper end surface of the lower inner rib to generate a stepped portion and on which the upper inner rib is seated; and a second seating surface which has a height lower than that of an upper end surface of the lower outer rib to generate a stepped portion and on which the upper outer rib is seated, and the second lower body is provided with a third seating surface which has a height lower than that of an upper end surface of the second lower coupling rib to generate a stepped portion and on which the second upper coupling rib is seated.

* * * * *